US007762691B2

(12) United States Patent
Pfund

(10) Patent No.: US 7,762,691 B2
(45) Date of Patent: Jul. 27, 2010

(54) LUMINAIRE HAVING A CONTOURED SURFACE THAT REDIRECTS RECEIVED LIGHT

(75) Inventor: David Pfund, Woodbridge, CT (US)

(73) Assignee: Sylvan R. Shemitz Designs, Inc., West Haven, CT (US)

( * ) Notice: Subject to any disclaimer, the term of this patent is extended or adjusted under 35 U.S.C. 154(b) by 69 days.

(21) Appl. No.: 11/404,356

(22) Filed: Apr. 14, 2006

(65) Prior Publication Data

US 2006/0232975 A1 Oct. 19, 2006

Related U.S. Application Data

(60) Provisional application No. 60/671,980, filed on Apr. 15, 2005.

(51) Int. Cl.
*F21V 7/00* (2006.01)

(52) U.S. Cl. ..... 362/298; 362/296.07; 362/346

(58) Field of Classification Search ..... 362/297–300
See application file for complete search history.

(56) References Cited

U.S. PATENT DOCUMENTS

| | | | | |
|---|---|---|---|---|
| 0,720,139 | A | 2/1903 | Hartung | |
| 5,530,628 | A | 6/1996 | Ngai | |
| 5,865,528 | A * | 2/1999 | Compton et al. | 362/300 |
| 6,185,357 | B1 | 2/2001 | Zou et al. | |
| 6,994,456 | B1 * | 2/2006 | Russo et al. | 362/364 |

OTHER PUBLICATIONS

International Search Report; PCT/US06/14290; Aug. 27, 2007.
Written Opinion, PCT/US06/14290; Aug. 27, 2007.

* cited by examiner

*Primary Examiner*—Ali Alavi
(74) *Attorney, Agent, or Firm*—Cantor Colburn LLP

(57) ABSTRACT

A luminaire for illuminating a target area, the luminaire including a reflective surface, where the reflective surface receives a light from outside of the luminaire and redirects the light toward the target area away from a viewing angle of the luminaire.

29 Claims, 26 Drawing Sheets

LUMINAIRE HAVING A CONTOURED SURFACE THAT REDIRECTS RECEIVED LIGHT

CROSS-REFERENCE TO RELATED APPLICATION

This application is related to and claims the benefit of U.S. Provisional Patent Application Ser. No. 60/671,980 filed on Apr. 15, 2005, the entire contents of which are herein incorporated by reference.

BACKGROUND OF THE INVENTION

This invention relates to luminaires used for directing light toward a specific area or surface. More particularly, this invention relates to luminaires used at workstations, for example in an office environment, that receive light reflected from workstation surfaces and that advantageously redirect that light away from a sightline of a viewer.

Task and task-ambient luminaires for workstations are well-known in the lighting industry. These luminaires are effective at providing task illumination in open office environments. Generally, they mount to open office workstation partitions (to provide, e.g., uplighting and downward task lighting) or to the underside of workstation shelves or elevated storage cabinets (to provide, e.g., only downward task lighting).

In addition to lighting horizontal work surfaces, task and task-ambient luminaires can illuminate, for example, the vertical privacy panel that extends upward from an edge of the work surface opposite the viewer. Such illumination can alleviate any shadowing of overhead ambient lighting caused by the luminaire, shelf, or storage cabinet. This illumination can also create balanced surround luminance for vertically-oriented tasks (e.g., viewing a video display terminal) in addition to traditional paper tasks.

Linear fluorescent lamps of nominal 1-inch (about 2.5 cm) diameter ("T8") or ⅝-inch (about 1.6 cm) diameter ("T5") are common for workstation applications. Luminaire installations typically include luminaires ranging from 2 feet (about 0.6 m) in length to as much as 8 feet (about 2.4 m) in length, each installation incorporating lamps of 2-foot (about 0.6 m), 3-foot (about 0.9 m), 4-foot (about 1.2 m), or 5-foot (about 1.5 m) length singly or in tandem, as dictated by the overall length of the lighting unit. Typically, these luminaires are positioned slightly above a viewer's seated eye height and coincident to the primary task area of the work surface.

A difficulty associated with positioning these luminaires involves the inter-reflection of light received by the underside of the luminaire from the lighted workstation surface located below the luminaire. Generally, panel-mounted and under-cabinet workstation luminaires having light-colored finishes and light-colored bottom surfaces indiscriminately redirect some of the inter-reflected light toward the viewer and out of the workstation. These disadvantageously redirected light rays reduce lighting efficiency at the workstation and can distract the viewer from his/her primary tasks. Such visual distraction outside of the viewer's main task focus can cause viewer annoyance and result in visual fatigue.

A known technique for preventing the indiscriminate redirection of light rays within a workstation is to provide a luminaire with a black finish. This results in the absorption of much of the inter-reflected light rays by the luminaire. However, the absorbed light rays are wasted in that they may have otherwise contributed to lighting the workstation if not for their absorption by the black luminaire surfaces. In addition, if an entirely black luminaire is not desired (e.g., for aesthetic reasons), providing a nonreflective finish on the underside of the luminaire can increase manufacturing complexity and costs.

Accordingly, it would be desirable to be able to provide a luminaire having a surface that advantageously redirects received light away from a sightline of a viewer, is simple and cost efficient to manufacture, and which redirects at least some of the received light toward a target area.

SUMMARY OF THE INVENTION

The invention provides a luminaire having a surface that advantageously redirects received light away from a viewer and toward a target area.

In accordance with the invention, luminaires having one or more contoured surfaces that redirect received light away from a viewer and toward a target area are provided.

The invention provides a luminaire for illuminating a target area, the luminaire including a reflective surface, where the reflective surface receives a light from outside of the luminaire and redirects the light toward the target area away from a viewing angle of the luminaire.

The invention further provides a luminaire for illuminating a target area, the luminaire including a lamp and a reflective surface, where the lamp emits a lamp light to illuminate the target area, where the reflective surface does not directly receive the lamp light, where the reflective surface receives an outside light from outside of the luminaire and redirects the light toward the target area and outside of a viewing angle of the luminaire, and where the viewing angle comprises an angle formed between a line tangent to the reflective surface and a sightline extending between an eye of a viewer and the reflective surface.

The invention also provides a workstation comprising a work surface and a luminaire for illuminating the worksurface, where the luminaire is mounted proximate to said work surface, where said luminaire comprises a reflective surface, and wherein the reflective surface receives a light from outside of the luminaire and redirects the light to the worksurface and away from a worker positioned at the workstation.

Additionally, the invention provides a method of illuminating a target area and preventing glare to a viewer. The method includes emitting a lamp light from a luminaire directly to the target area, receiving an outside light at the luminaire, and redirecting the outside light to the target area and away from a sightline which extends from a viewer to the luminaire. In this way, the redirected light is provided to the target area and is not visible along the sightline and thus does not present a glare to the viewer. Notably, the outside light is not received directly from the luminaire.

BRIEF DESCRIPTION OF THE DRAWINGS

The above and other advantages of the invention will be apparent upon consideration of the following detailed description, taken in conjunction with the accompanying drawings, in which like reference characters refer to like parts throughout, and in which.

DETAILED DESCRIPTION OF THE INVENTION

The invention improves lighting in workstations and other applications by advantageously redirecting light rays received by the luminaire from the surroundings in a direction away from a sightline of a viewer. Generally, the received light rays are redirected below the sightline toward a work-surface(s) of the particular workstation. Such light rays otherwise would be absorbed by a nonreflective surface of the luminaire or would be indiscriminately redirected away from the target area/surface and perhaps into the sightline of the viewer creating a distracting glare.

Figure 1:
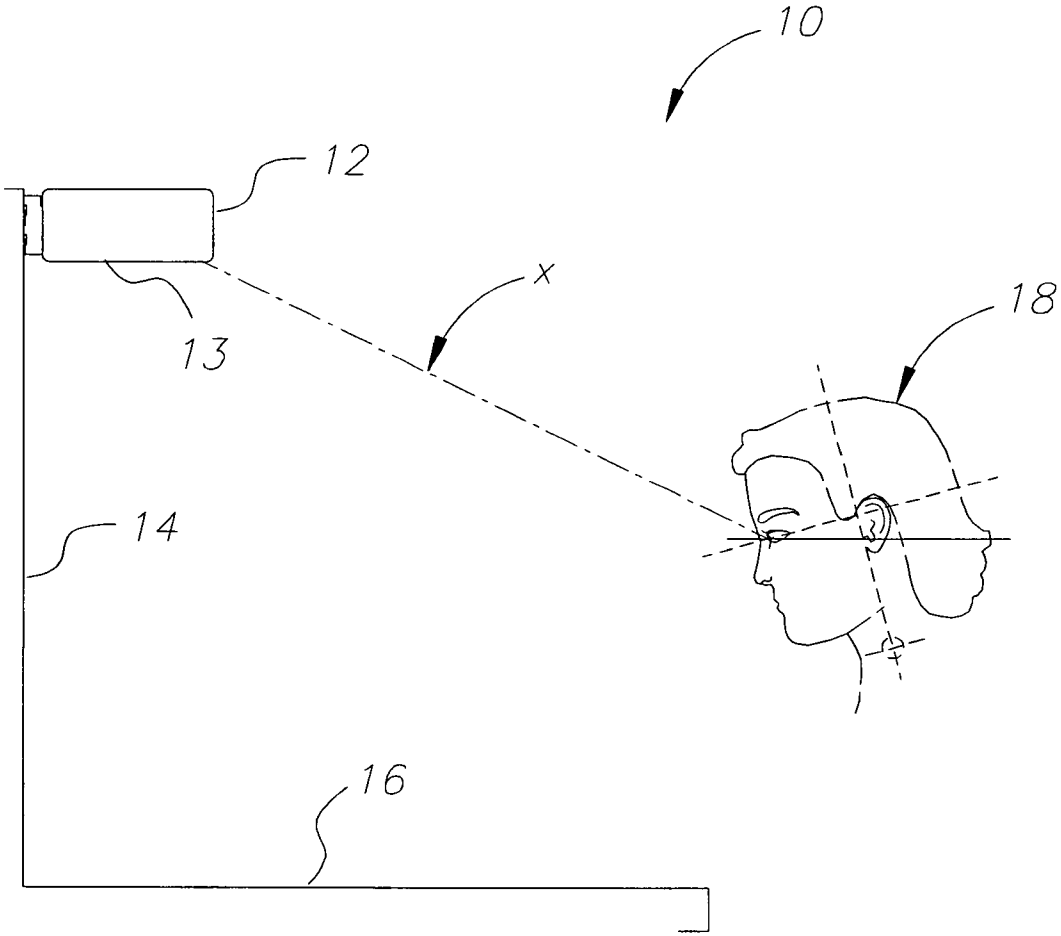
FIG. 1 is a simplified profile view of a workstation.

FIG. 1 shows a typical workstation 10 that includes a luminaire 12, vertical workstation surface 14 and horizontal workstation surface 16. A viewer 18 is positioned typically within the workstation, resulting in sightline "x" as defined by nearest edge of underside 13 of luminaire 12 and the eye position of said viewer. Luminaire 12 may be panel-mounted on vertical workstation surface 14 to provide direct task lighting (i.e., downlighting) and possibly also indirect ambient lighting (i.e., uplighting). Alternatively, luminaire 12 may be mounted beneath a cabinet (not shown) and accordingly used as an undercabinet task light. The underside 13 of luminaire 12, as used in workstation 10, is subjected to light reflected back from one or both of vertical and horizontal workstation surfaces 14 and 16, respectively, to the extent that surfaces 14 and 16, or items placed thereon, are reflective. Known luminaires are not designed to intentionally redirect light rays reflected from surfaces 14 and 16 below the sightline and back within workstation 10.

Figure 2:
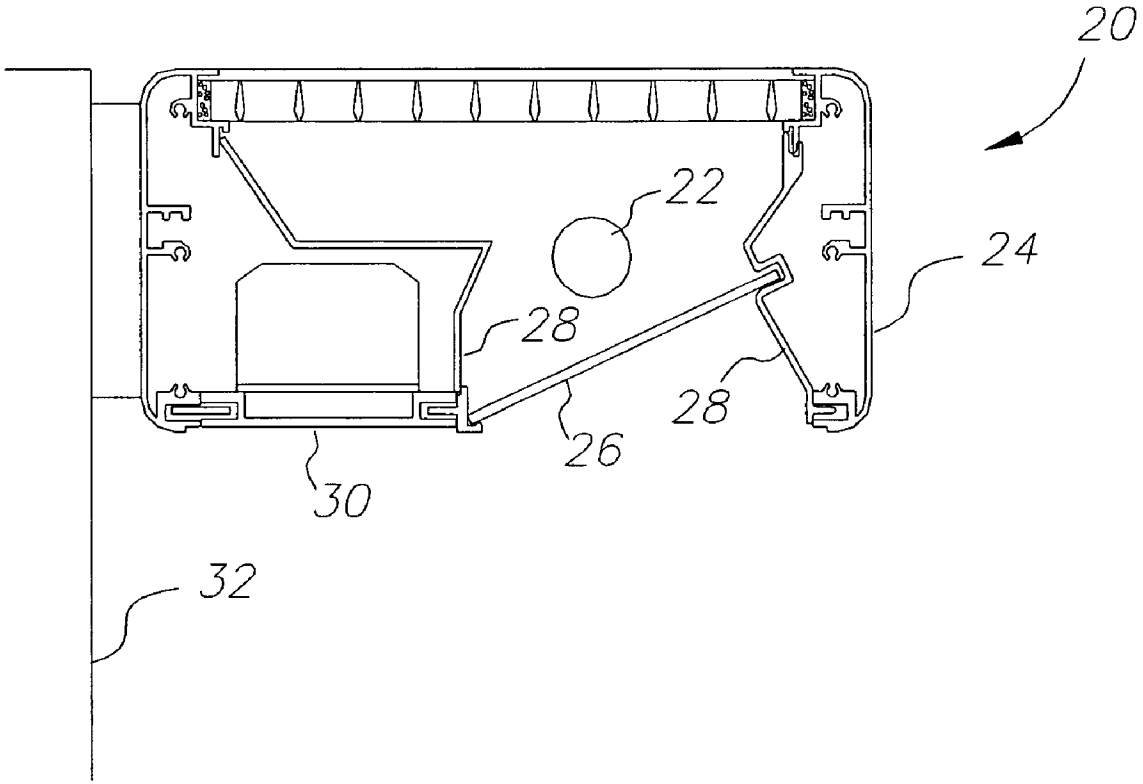
FIG. 2 (PRIOR ART)
FIG. 2 is a cross-sectional view of a typical luminaire for a workstation.

FIG. 2 shows a known luminaire 20, which includes a lamp 22 enclosed within a housing 24. Luminaire 20 is attached to vertical surface 32 of a workstation. Light passes through lens 26 and interacts with reflectors 28. Typically, to avoid the indiscriminate redirection of light rays to the sightline of a viewer and within and beyond the workstation, underside 30 of luminaire 20 is provided with a black finish. Alternatively, underside 30 can be an inherently black component (e.g., molded in a black material). The black finish absorbs at least some of the inter-reflected light rays within the workstation. However, producing this absorptive underside 30 can complicate and increase the expense of manufacturing the luminaire 20. Also, this absorption of light rays by underside 30 is an inefficient use of the light provided by lamp 22. Rather than absorbing (i.e., wasting) the inter-reflected light, redirecting that light back within the workstation would increase efficiency.

Figure 3:
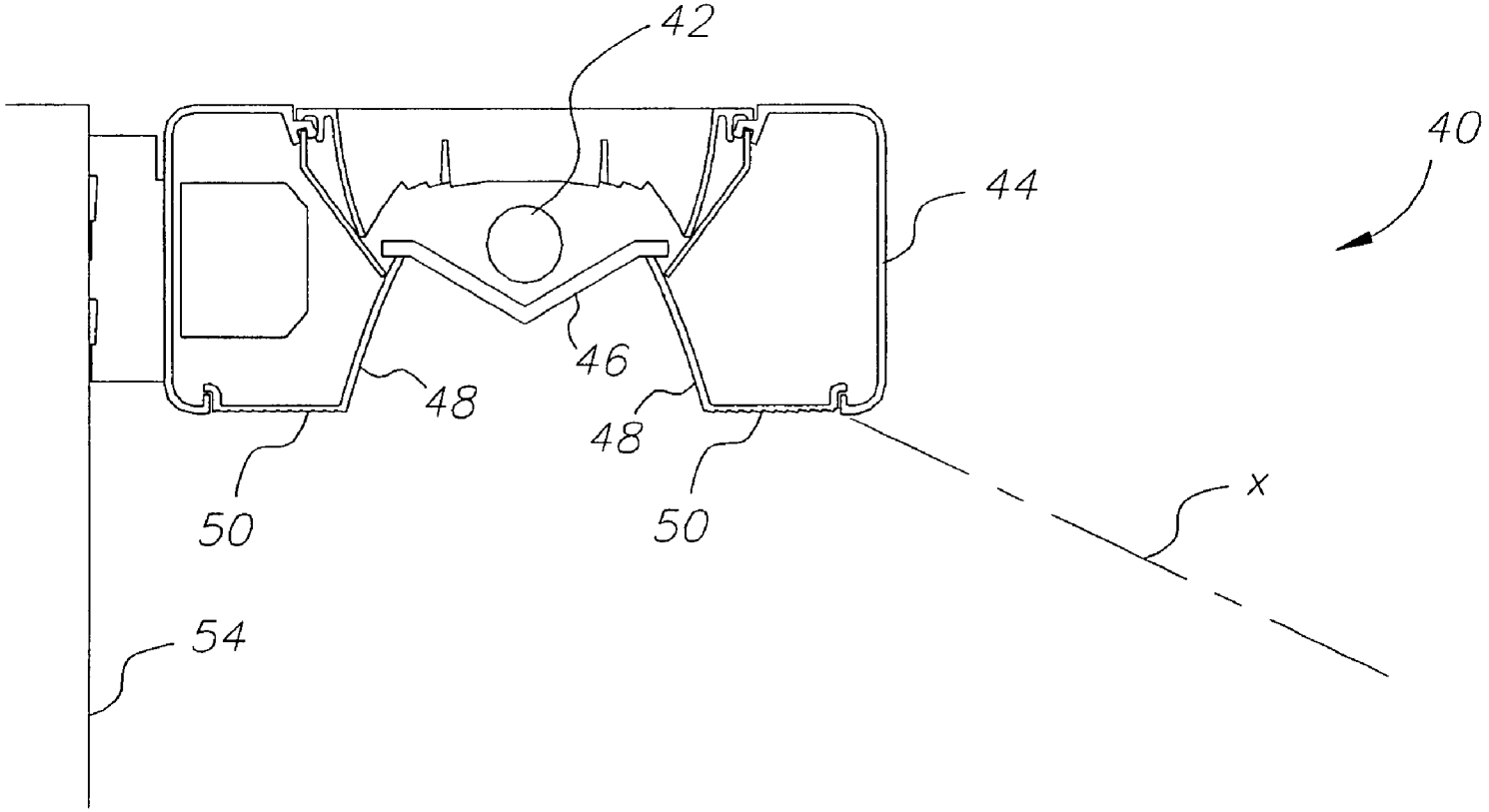
FIG. 3 is a cross-sectional view of an illustrative luminaire having surfaces for redirecting received light in accordance with the invention.
Figures 4A, 4B, 4C:
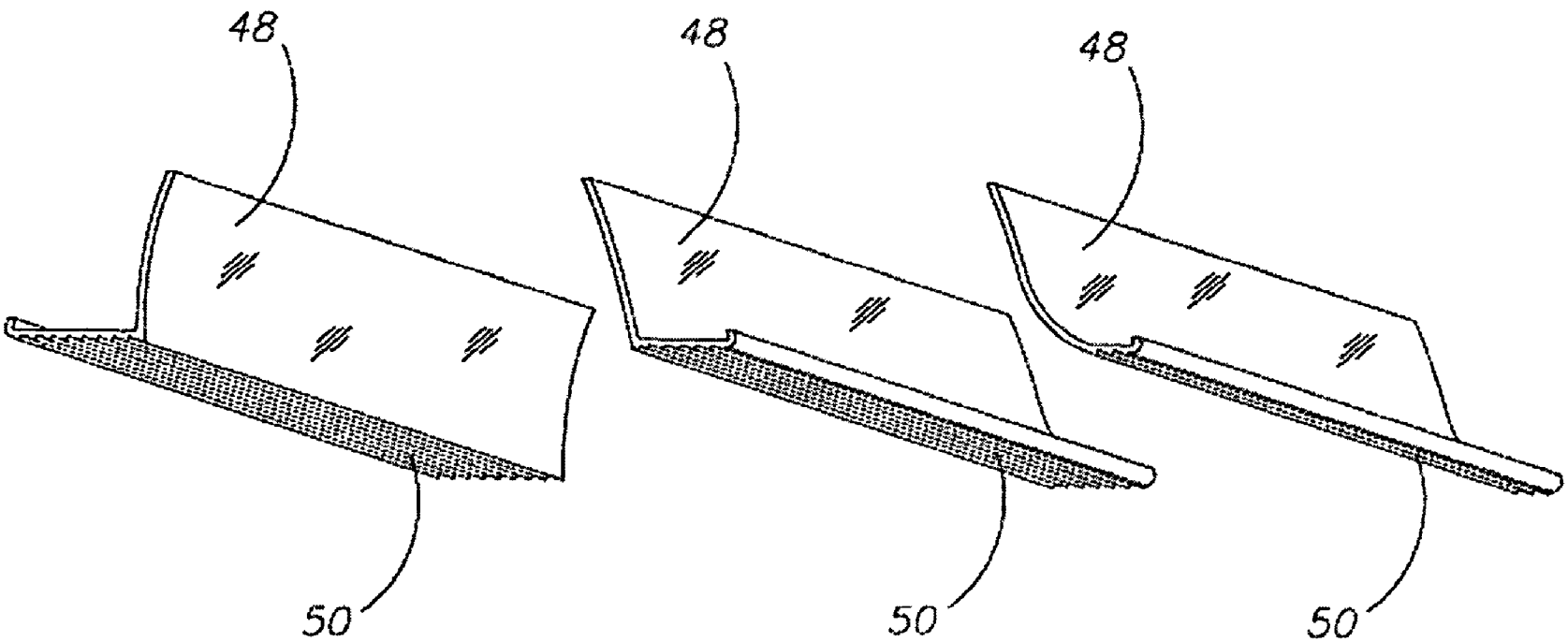
FIGS. 4A-C are perspective views of luminaire reflectors integrally formed with surfaces for redirecting received light in accordance with the invention.

FIG. 3 shows an illustrative luminaire 40 having surfaces for advantageously redirecting received light in accordance with the invention. Luminaire 40 includes a lamp 42 enclosed within a housing 44. Luminaire 40 is attached to vertical surface 54 of a workstation. Light from lamp 42 may be directed through a lens 46. Reflectors 48 form a downlight aperture of luminaire 40. In contrast to the typically black underside 30 of known luminaire 20 (of FIG. 2), the underside of luminaire 40 includes contoured surfaces 50 that advantageously redirect light rays received from the workstation back within the workstation and below sightline "x" (as defined above). In particular, surfaces 50 each have a series of grooves/ridges (e.g., "sawtoothed" profiles) that perform the desired redirection of received light rays.

As shown in FIGS. 3 and 4A-C, in some embodiments of the invention, surfaces 50 are preferably integral extensions of reflectors 48. Reflectors 48, like typical luminaire reflectors, are provided with an optically specular finish to improve luminaire performance and efficiency. As extensions of reflectors 48, surfaces 50 are provided with an identical or similar finish to reflect incident light rays. By extending reflectors 48 to form surfaces 50, the remaining exterior surfaces of luminaire 40 (e.g., housing 44) may be more simply finished (e.g., painted) without regard to reflective qualities and characteristics. Moreover, a separately finished bottom closure is no longer needed.

Figure 5:
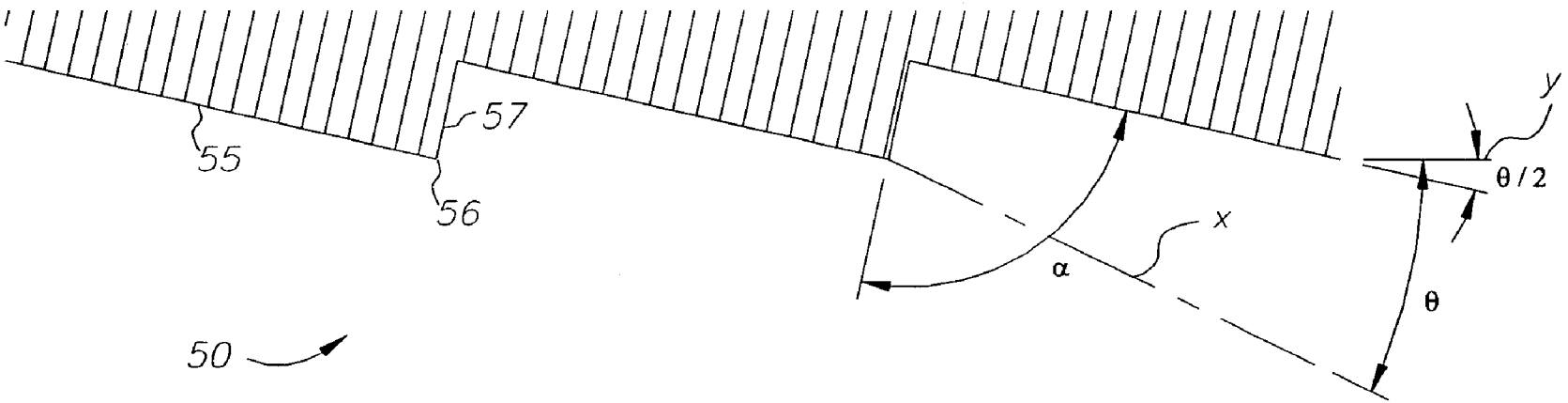
FIG. 5 is an enlarged cross-sectional profile view of a portion of a surface for redirecting received light in accordance with the invention.

FIG. 5 shows an enlarged cross-sectional view of contoured surface 50 in accordance with the invention. Contoured surface 50 is fabricated to have a series of continuous longitudinal grooves/ridges, where the longitudinal direction is into the page of FIG. 5 (i.e., the longitudinal direction runs generally parallel to the aforementioned lighted workstation surfaces and generally perpendicular to the typical viewing direction). The longitudinal grooves/ridges of the luminaire 40, in cross-section, are comprised of a plurality of long lateral profile segments 55 each connected by a corresponding plurality of short lateral profile segments 57. Due to the orientation of the long and short segments 55 and 57, respectively, a series of peaks 56 are formed. In this example, the long and short segments have lateral widths of approximately 0.10" and approximately 0.02" respectively and are arranged to form approximately 22 grooves/ridges (approximately 11 on each side of the aperture).

Angle $\alpha$ between each long lateral profile segment 55 and short lateral profile segment 57 of each groove is preferably approximately 90° (although other angles are possible as described below).

The angle formed by each long lateral profile segment 55 and a line y tangential to peaks 56 of each ridge is $\theta/2$, where $\theta$ is the angle between the tangent line y and the sightline x. As discussed further hereinbelow, $\theta$ may typically range between about 10° to about 50°. At this angle, light rays received by segment 55 from workstation surfaces located under the luminaire, or from elsewhere, are redirected back into the workstation area and specifically toward the lighted workstation surfaces at angles, with respect to the tangent line y, greater than $\theta$ such that the redirected light is kept below the sight line x. This is the case where the angle of surface 55 is greater than $\theta/2$. However, even with the angle of surface 55 equal to $\theta/2$, only a theoretical light ray traveling tangent to the contoured surface/ridges and striking the very bottom edge of the surface 55 closest to the viewer would follow the sightline. All others, even those redirected at the sightline angle $\theta$, will fall below the sightline. In fact, if a light ray were redirected at an angle slightly less than $\theta$, it might still remain below the sightline if it originates from a distant segment of the contoured surface (far from the viewer). Thus, generally, light reflected from the contoured surface at angles $>\theta$ will not violate the sightline—the only exception being the theoretical ray reflected at angle $\theta$ from the point where the sightline intersects the luminaire.

Thus, orienting segment 55 in this manner maintains a low-brightness appearance. That is, segments 55 redirect the light to the workstation surfaces below the sightline x, thus avoiding visual noise in the viewer's peripheral vision.

Figure 6:
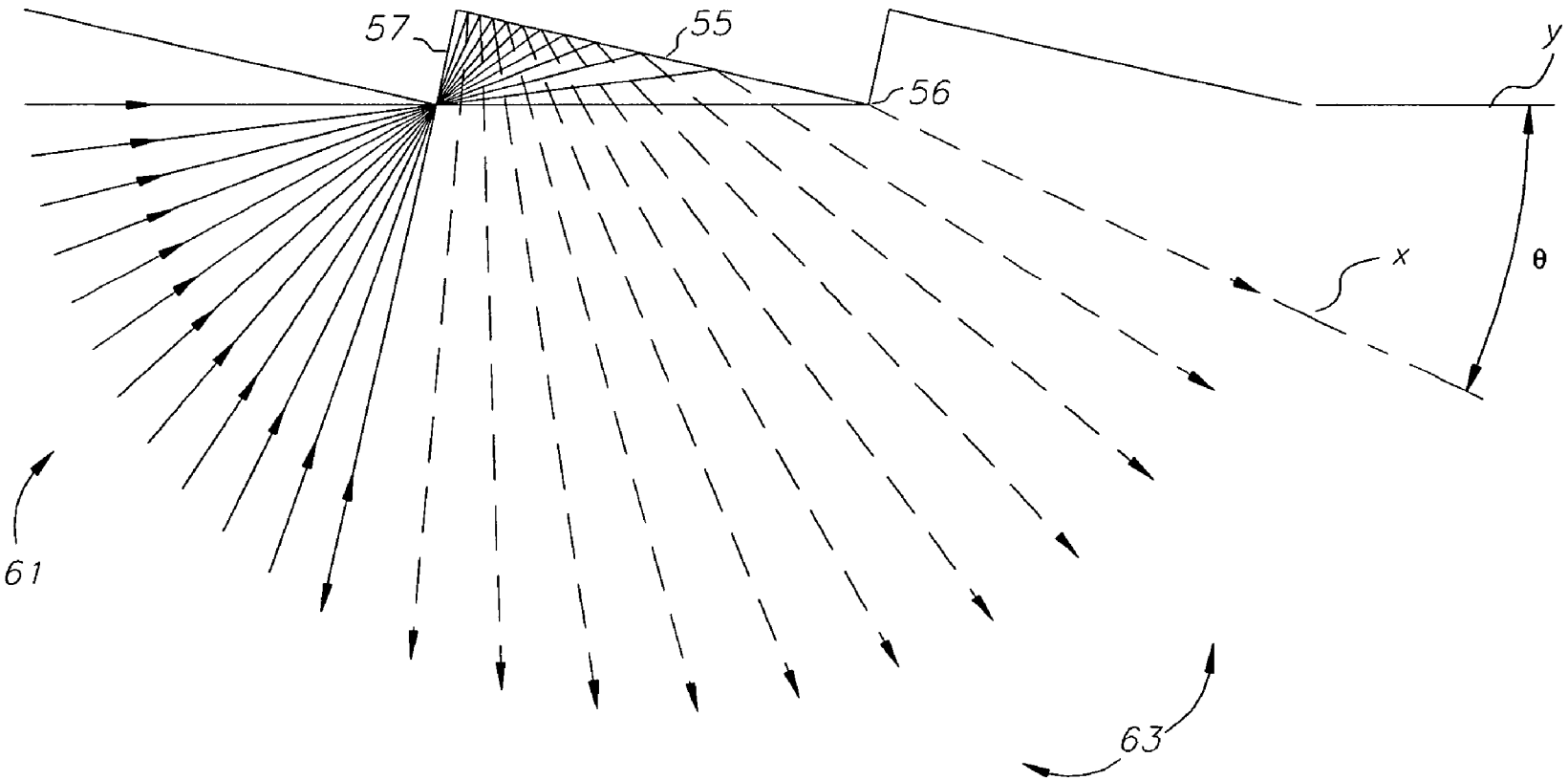
FIG. 6 is a representation of the redirection of received light rays at the surface of FIG. 5 in accordance with the invention.

FIG. 6 illustrates the redirection of a set of light rays 61 received by long segment 55 of surface 50. Light rays 61 may be light reflected back from workstation surfaces (note that the invention does not require that light rays 61 be "reflected" light rays or that received light rays originate from within a workstation). Notably, all redirected light rays 63 occur at angles, with respect to tangent line y, which are greater than $\theta$ such that the light rays 63 are kept below the sightline x.

Figure 7:
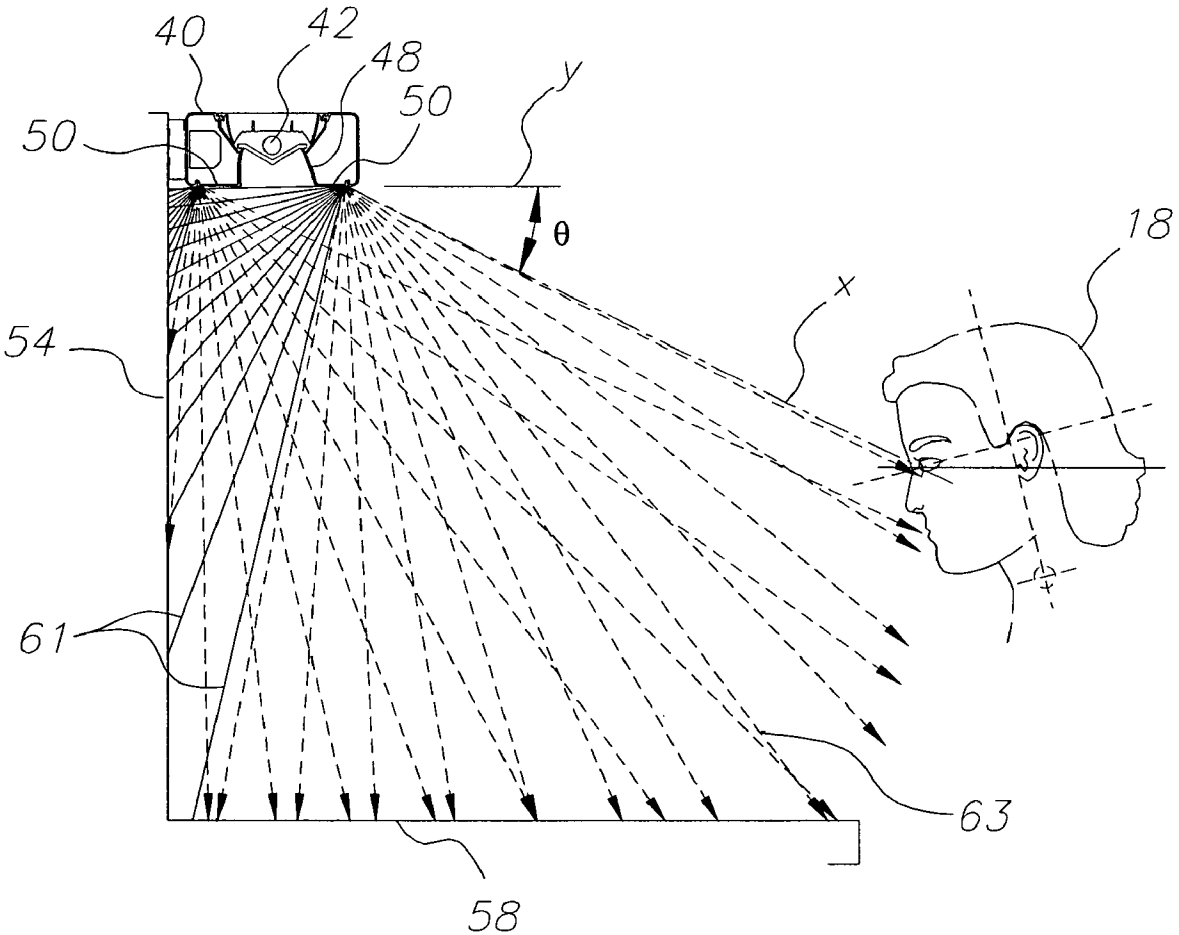
FIG. 7 is a simplified view illustrating a workstation including a luminaire having the surface of FIG. 5 and further illustrating the redirection of light rays as shown in FIG. 6 in accordance with the invention.

FIG. 7 illustrates the redistribution of light rays 61 within a workstation by the respective long lateral profile segments 55 of surface 50 nearest to and farthest away from the viewer. For clarity, only the received light rays 61 and the redirected rays 63 are shown. Light rays received by other segments of surface 50 and those emanating from the lamp 42, for example, are omitted. The light rays 61 generally represent light reflected by the vertical workstation surface 54 to the surfaces 50 of the luminaire 40. Note that surfaces 50 do not receive light directly from either a lamp or reflector of the luminaire. Also note that all of the redirected rays 63 (shown here in broken lines) are kept below the sight line x and that most of the redirected rays 63 are sent to a horizontal work surface 58 of the workstation.

Figure 8:
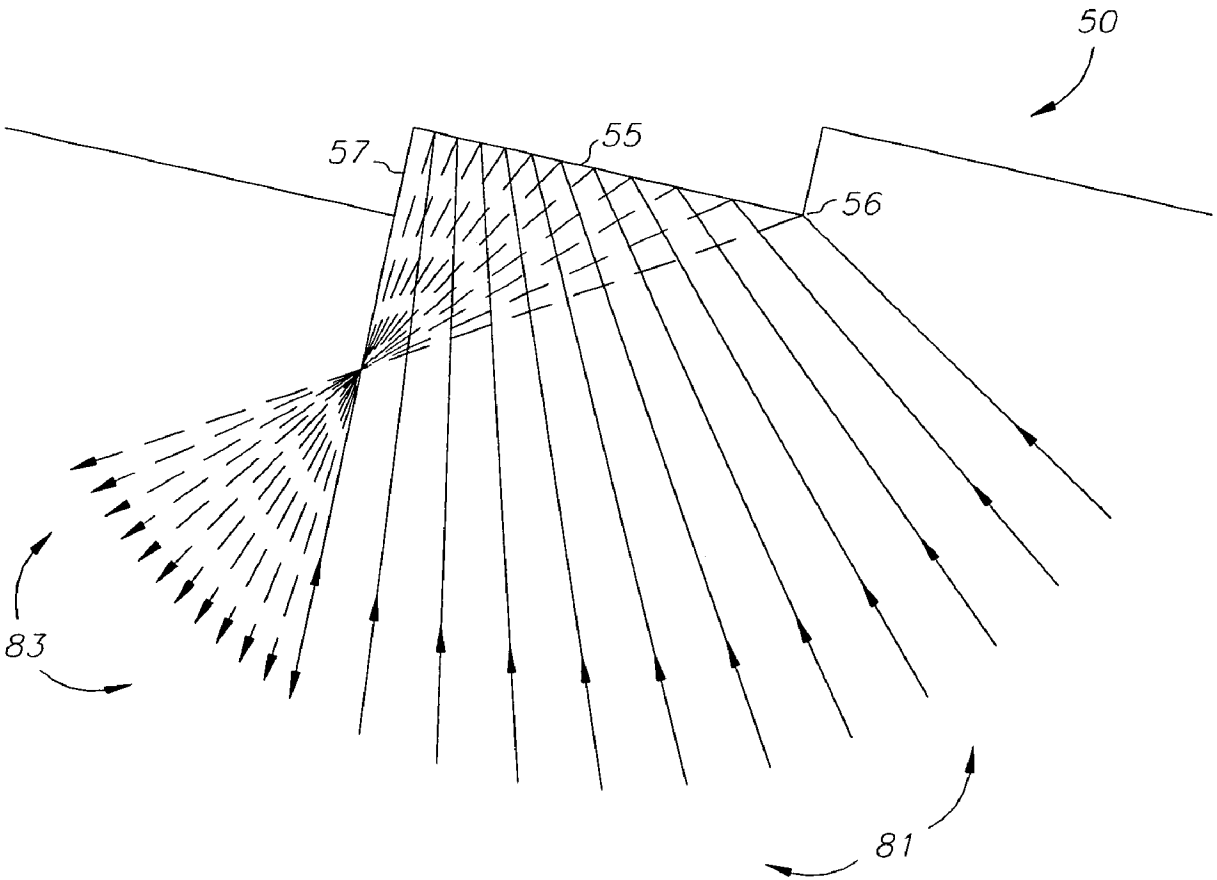
FIG. 8 is another representation of the redirection of received light rays at the surface of FIG. 5 in accordance with the invention.

FIG. 8 illustrates the redirection of another set of light rays 81 received by the long lateral profile segments 55 of the surface 50. Again, these light rays 81 received by surface 50 may be light reflected back from workstation surfaces, or reflected from other surfaces, or emitted by sources etc., within or outside of the workstation.

Figure 9:
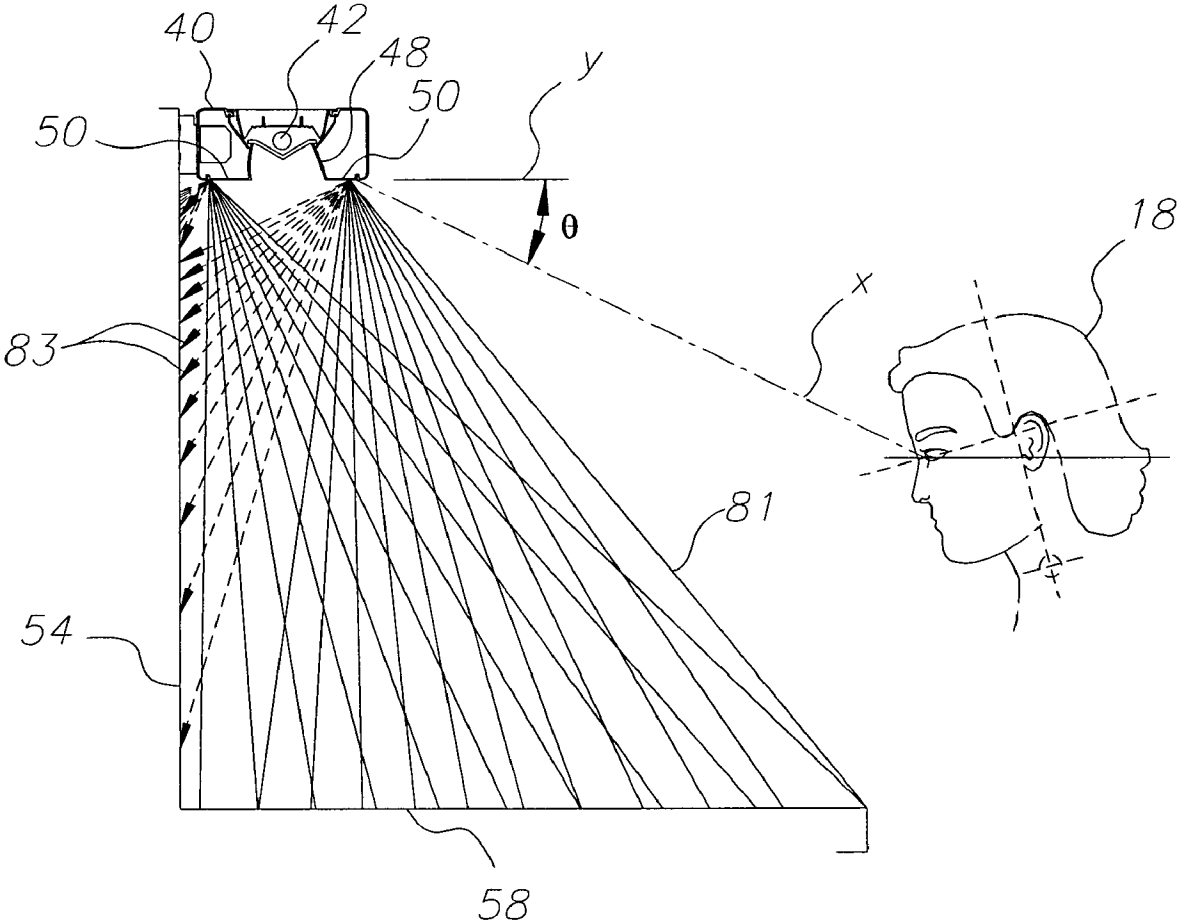
FIG. 9 is a simplified view illustrating the workstation of FIG. 7 and the redirection of light rays as shown in FIG. 8 in accordance with the invention.

FIG. 9 illustrates the redistribution of the light rays 81 within a workstation by the respective grooves/ridges of surfaces 50 nearest to and farthest away from the viewer. (Here again, for clarity, only the light rays 81, 83 are shown.) The light rays 81 generally represent light reflected from the horizontal work surface 58 to the long lateral profile segments of surfaces 50 at the underside of the luminaire 40. Notably, all of the received light rays 81 are redirected by the surfaces 50 to the lighted vertical surface 54 of the workstation. Here again, the redirected light rays 83 are kept below the sightline x and out of the viewing angle $\theta$. Moreover, the long lateral profile segments 55 redirect the light rays 83 in a direction away from the viewer 18. It is noted that, in the presently discussed embodiments, only surfaces 55 will direct light away from the viewer. Light rays received by surfaces 57 will direct light toward the viewer but below the sightline if the light was initially received (by surface 57 or by surface 55) at an angle $>\theta$.

Figure 10:
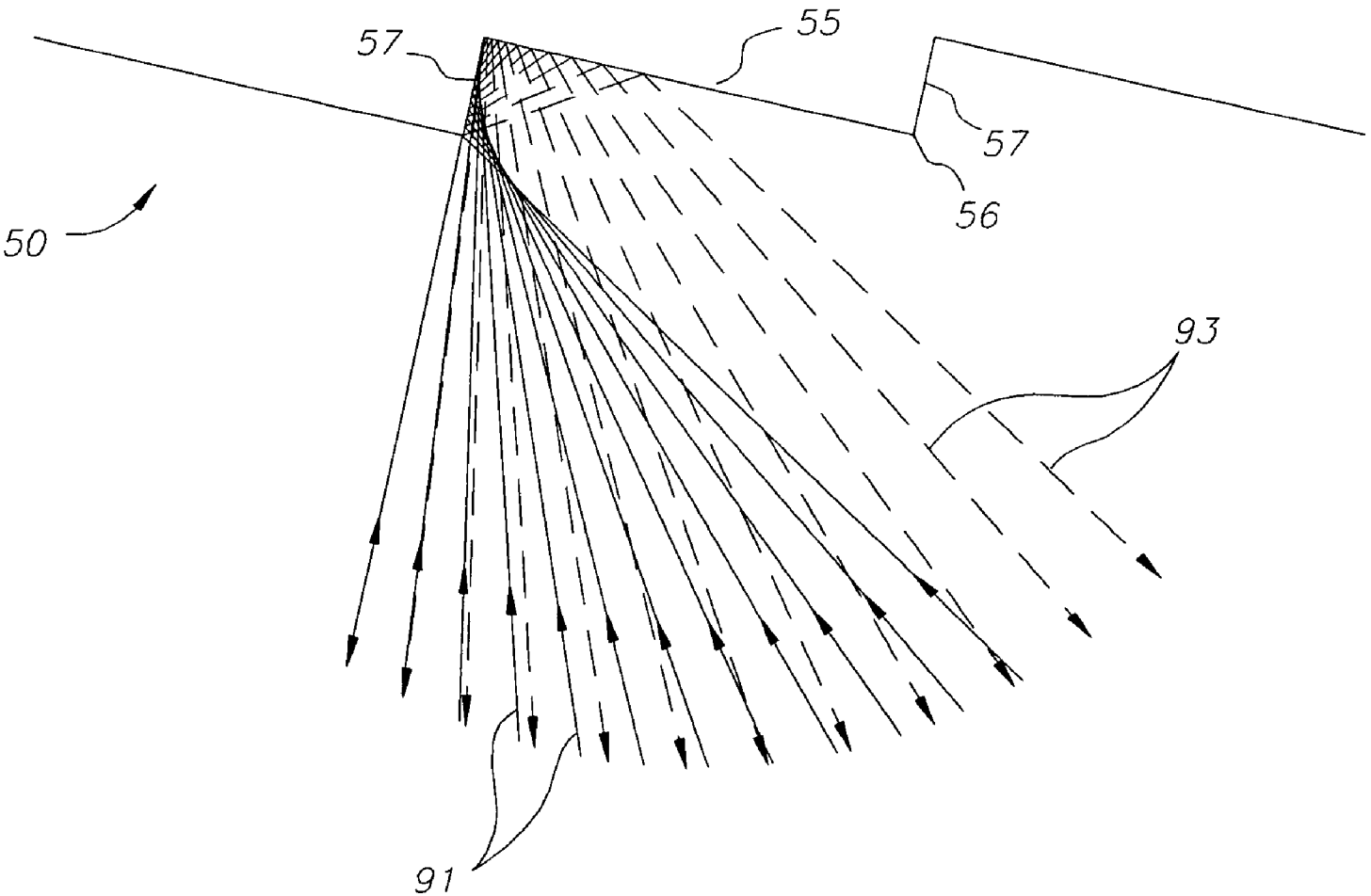
FIGS. 10 and 11 are representations of still other redirections of received light rays at the surface of FIG. 5 in accordance with the invention.
Figure 11:
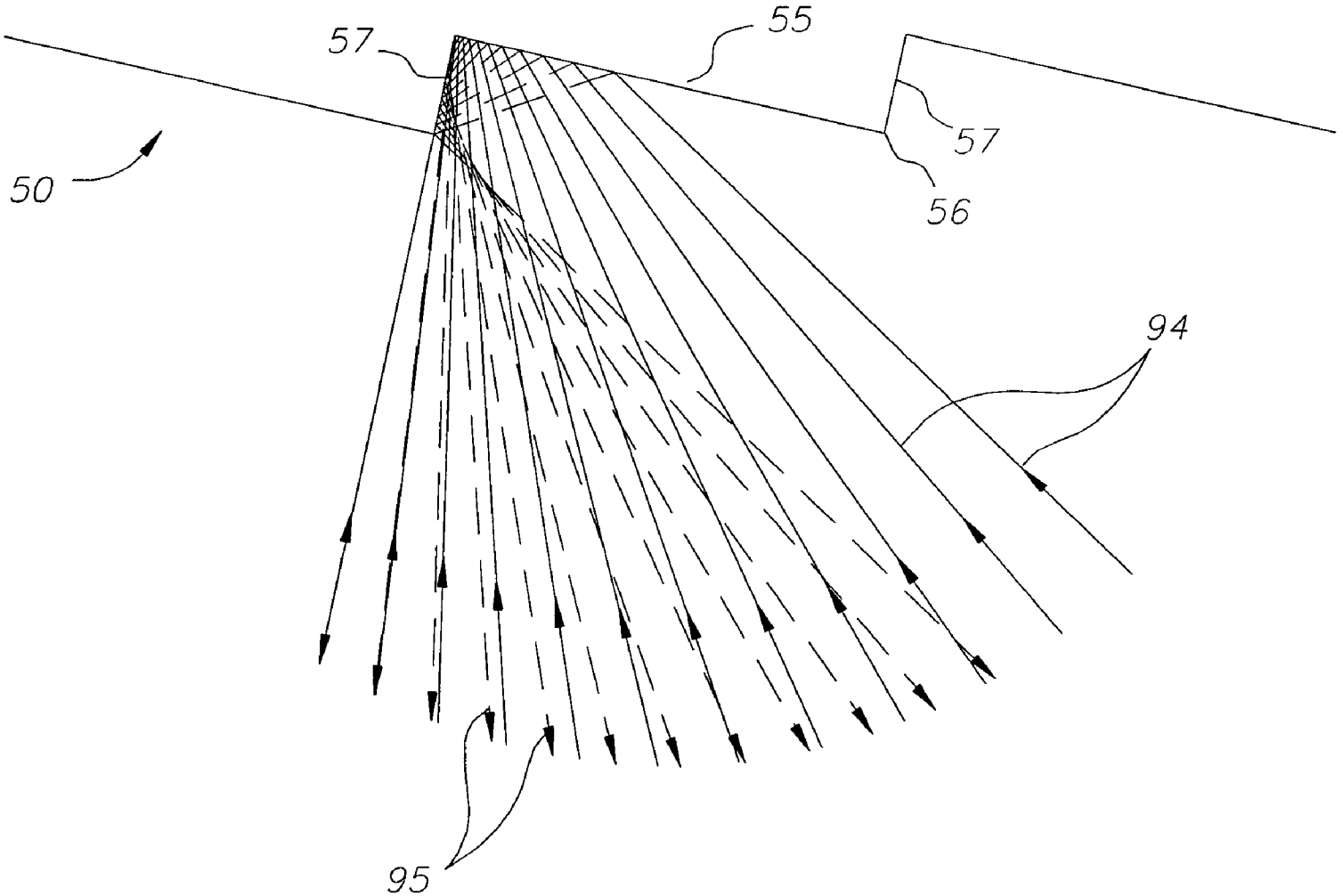

FIGS. 10 and 11 illustrate the interaction of surface 50 with still other received light rays. In FIG. 10, received light rays 91 incident upon the surface 50 are first redirected by the short lateral profile segment 57 of surface 50 toward the adjacent long lateral profile segment 55, said long lateral profile segment 55 secondly reflecting redirected light rays 93. Similarly, incident light rays 94 shown in FIG. 11 are first received by the long lateral profile segment 55 of surface 50 and redirected toward the adjacent short lateral profile segment 57, said short lateral profile segment secondly receiving and reflecting redirected light rays 95 back toward the worksurface. Advantageously, because angle $\alpha$ (see FIG. 5) between the respective long lateral profile segments 55 and short lateral profile segments 57 is approximately 90° the redirected light rays 93, 95 of both FIGS. 10 and 11 (shown in broken line) are generally parallel to the received light rays 91 and 94 of both FIGS. 10 and 11 (shown in solid line). Some of these rays 93, 95, specifically those at the far left of the set that are normal to the reflective surface, are reflected directly back along the line of incidence and, clearly, away from the sightline of the viewer.

Figure 12:
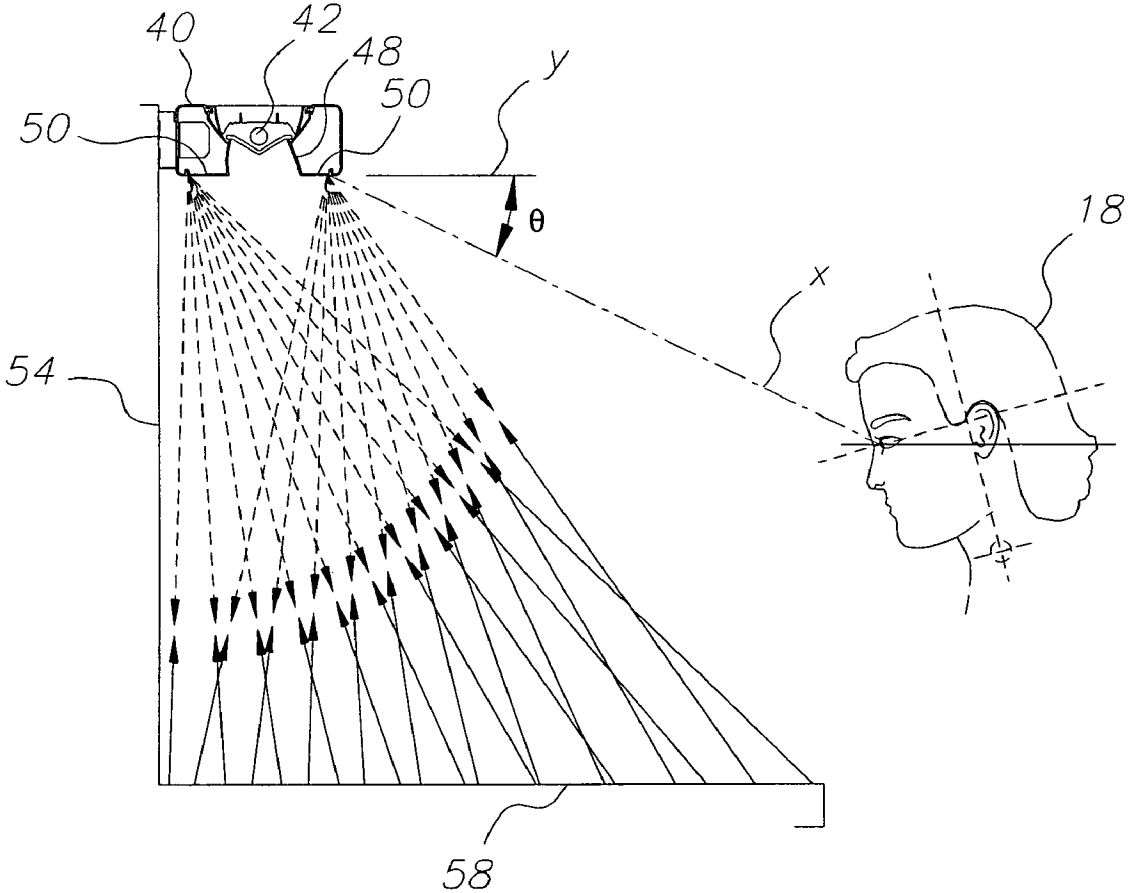
FIG. 12 is a simplified view illustrating the workstation of FIG. 7 and the redirection of light rays as shown in FIGS. 10 and 11 in accordance with the invention.

FIG. 12 further illustrates the advantageous redirection of a similar set of light rays within a workstation back along (i.e. parallel to) their lines of incidence to the workstation surface from which they were reflected. In both FIG. 10 and FIG. 11, the exiting light rays, 93 and 95 respectively, travel away from surface 50 at an angle equal to the angle of incidence and along, or slightly offset from, their original path. This FIG. 12 generally represents the arrangements of both FIG. 10 and FIG. 11 as applied to a workstation. As shown, the surfaces 50 advantageously redirect the incident light 91 and 94 at an angle greater than $\theta$ delimiting the sightline thus preventing the viewer from experiencing a distracting glare.

Figure 13:
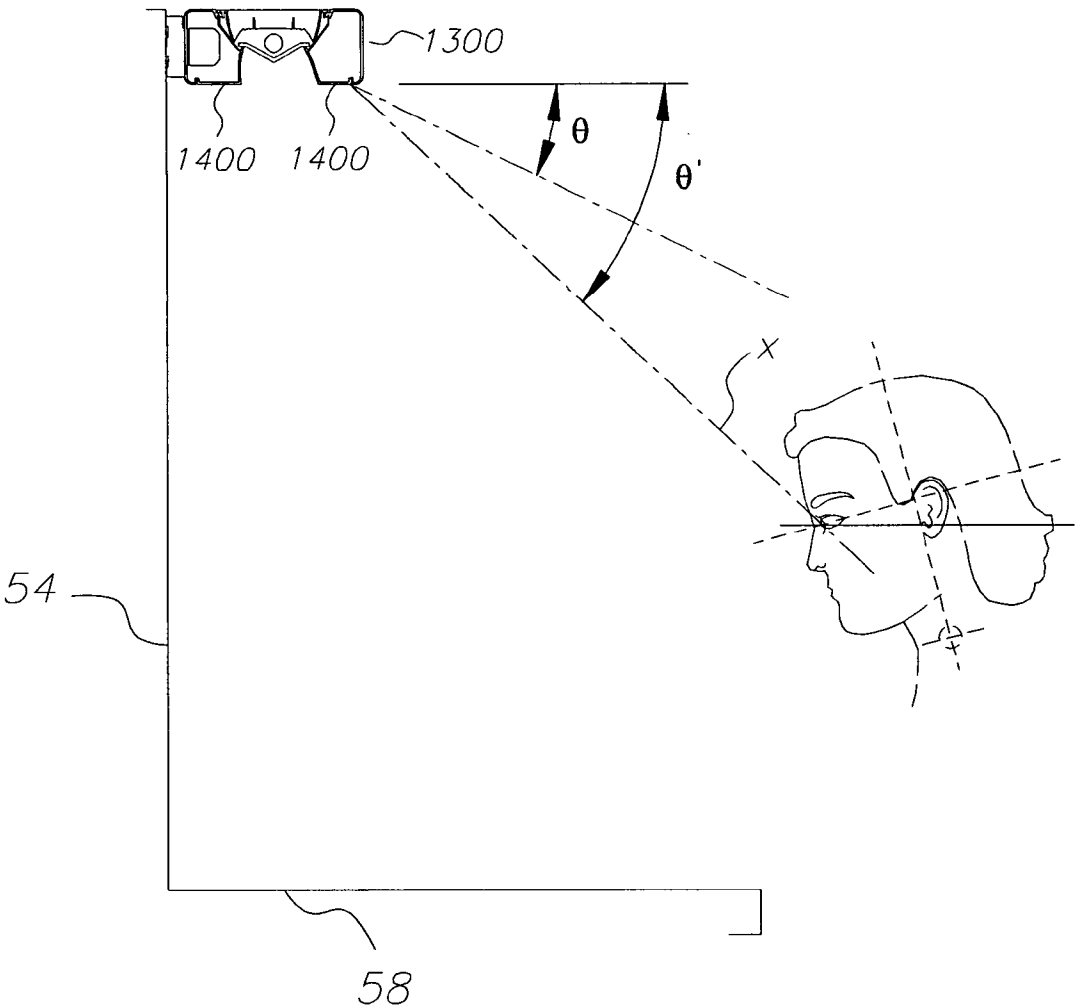
FIG. 13 is a simplified view of another illustrative luminaire having surfaces for redirecting received light in accordance with the invention.

FIG. 13 illustrates another embodiment of the invention. Therein, a luminaire 1300 has contoured surfaces 1400 for redirecting received light relative to the tangent line y (defined above) at angles greater than a viewing angle θ', where θ' is greater than angle θ as defined above. Angle θ' corresponds, for example, to a different luminaire mounting height or workstation depth or both. Typically, angle θ' will range between 10° and 50°. Here, in essence, the angle of the sightline x has changed due to an alternate positioning of the luminaire 1300 and thus the viewing angle θ' is correspondingly increased. Contoured surfaces 1400 are preferably integrally formed extensions of the specular downlight reflectors of luminaire 1300 and preferably form the bottom closures of luminaire 1300.

Figure 14:
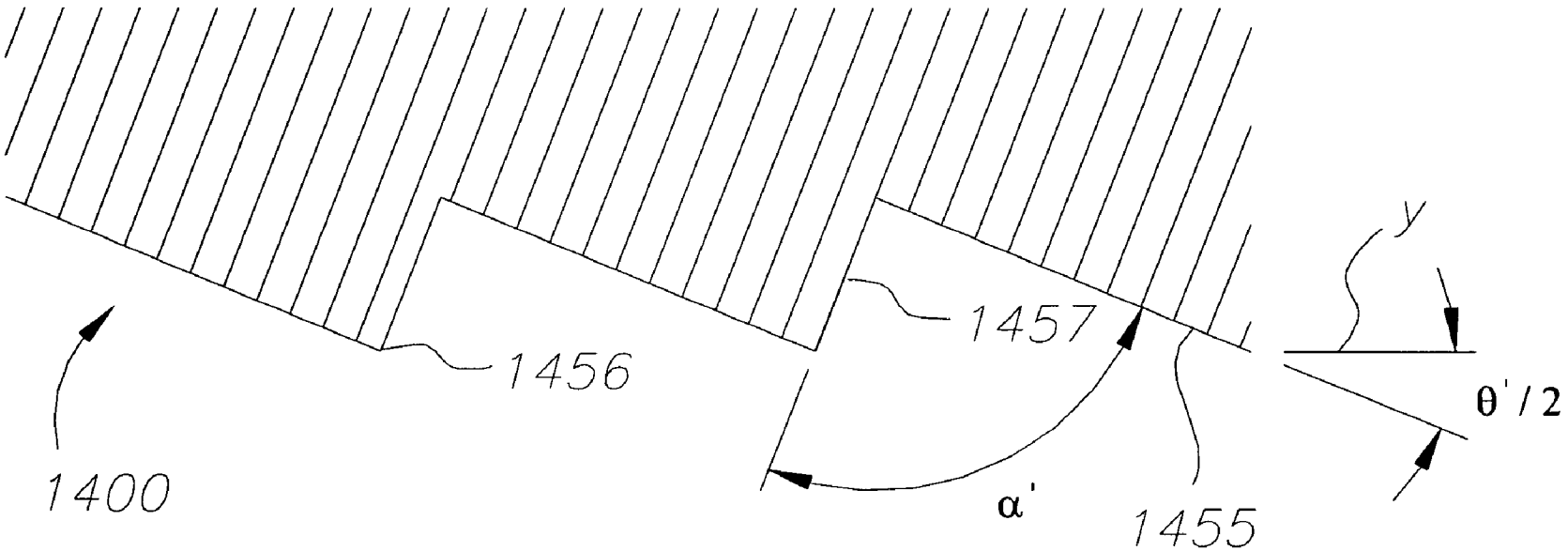
FIG. 14 is an enlarged cross-sectional profile view of a portion of another surface for redirecting received light in accordance with the invention.

FIG. 14 is an enlarged cross-sectional profile view of surfaces 1400. Angle α' between long lateral profile segment 1455 and short lateral profile segment 1457 of each groove is preferably approximately 90°, and the angle formed by each long segment 1455 and the line y tangential to peaks 1456 of each ridge is θ'/2, where θ/2 is approximately 5°-25°.

Figure 15:
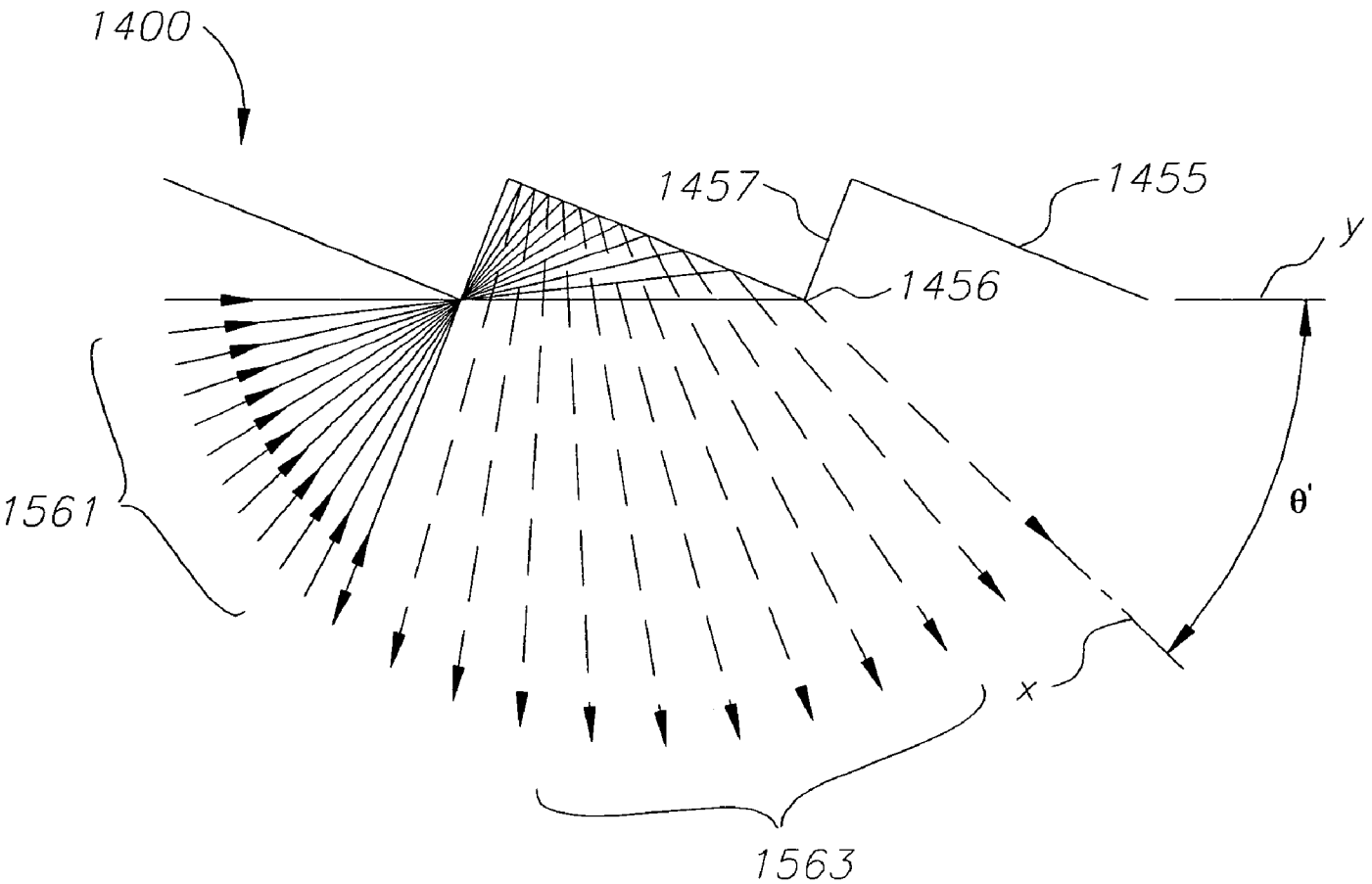
FIG. 15 is a representation of the redirection of received light rays at the surface of FIG. 14 in accordance with the invention.

FIG. 15 illustrates the redirection of a set of light rays 1561 (e.g., originating from within, and/or from outside, and/or reflected back from a workstation) received by surface 1400. Again, note that all redirected light rays 1563 occur at angles, with respect to the tangent line y, which are greater than the viewing angle θ'. Thus, all redirected light rays 1563 are kept outside the viewing angle θ' and below the sightline x.

Figure 16:
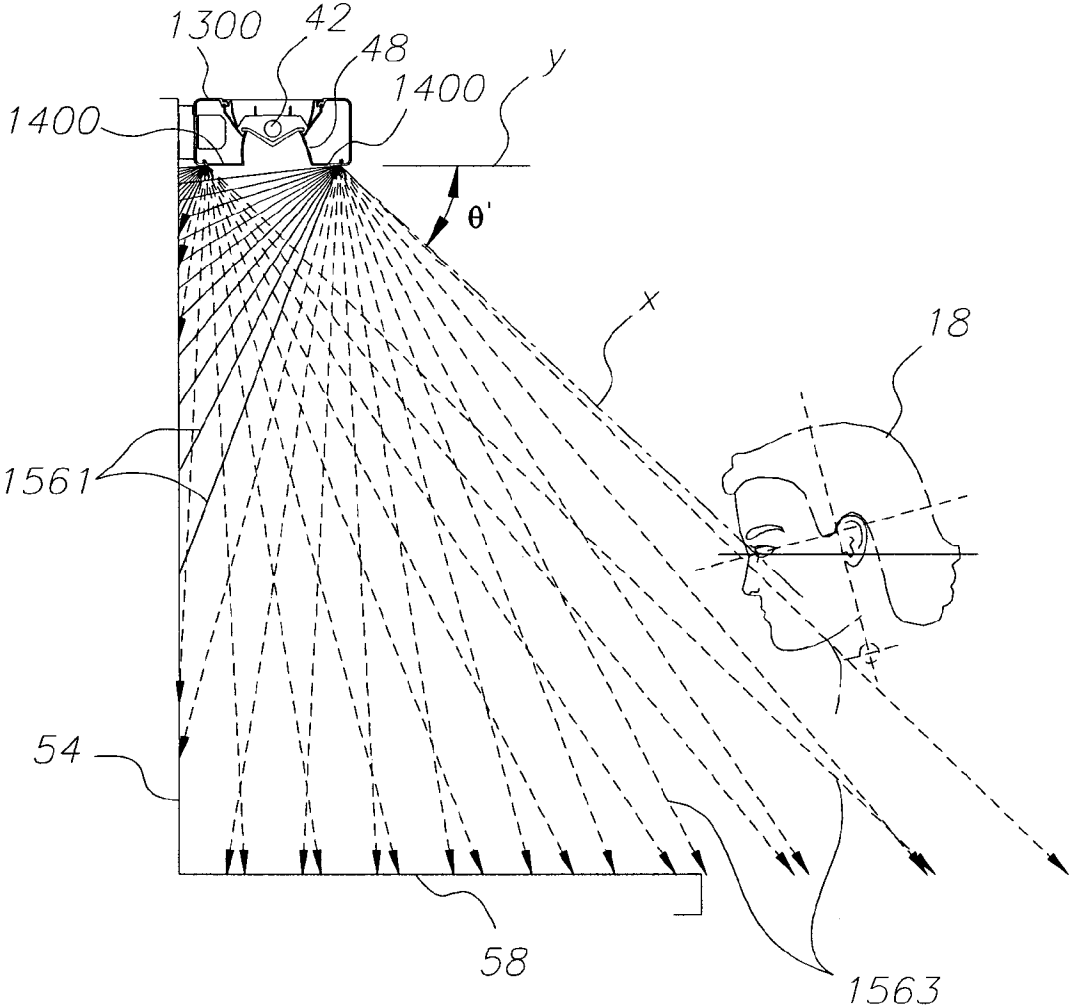
FIG. 16 is a simplified view illustrating a workstation including a luminaire having the surface of FIG. 14 and further illustrating the redirection of light rays as shown in FIG. 15 in accordance with the invention.

FIG. 16 illustrates the redistribution of the light rays 1561, 1563 within a workstation by the respective grooves/ridges of surfaces 1400 nearest to and farthest away from the viewer 18. As shown, all of the received light rays 1561 are reflected by the surfaces 1400 such that the redirected light rays 1563 are sent back to the workstation surfaces at angle greater than θ' and are thus maintained away form the sightline X and generally outside of the viewing angle. Advantageously, all other light rays originating from within or from outside the workstation and incident on the long lateral profile segments 1455 of surfaces 1400 or incident on the short segments 1457 at an angle greater than θ' are redirected back away from the sightline X to the workstation in a manner similar to that shown in FIGS. 3-12 of the first embodiment of the invention.

As described above, orienting the referenced long lateral profile reflector segments according to a selected viewing angle θ or θ' (depending upon the mounting disposition of the luminaire) directs light rays reflecting from said segments to targets occurring below a sightline defined by said viewing angle. Advantageously, this minimizes the light rays which are redirected at or above the sightline X and in the viewing angle and thus reduces or negates distracting glare to the viewer which may otherwise occur at the underside of the luminaire. Another effect of the invention, as discussed, is that this redirected light is generally sent toward work surfaces of the work station, thus contributing to an improved overall luminance. It is noted that, although directing some light rays close to the viewing angle can advantageously result in a broad, highly uniform and far-reaching lighting distribution that extends beyond the primary task surface(s) of a workstation, orienting the long lateral profile segments of the reflector at angles greater than θ/2 or θ'/2 respectively can direct more of the reflected light rays back toward the lighted surfaces directly below the luminaire. This can be particularly advantageous when a greater illuminance is desired on vertical workstation surface 14, 54, etc. (see, e.g., FIG. 1) or a similar surface such as a wall.

Figure 17:
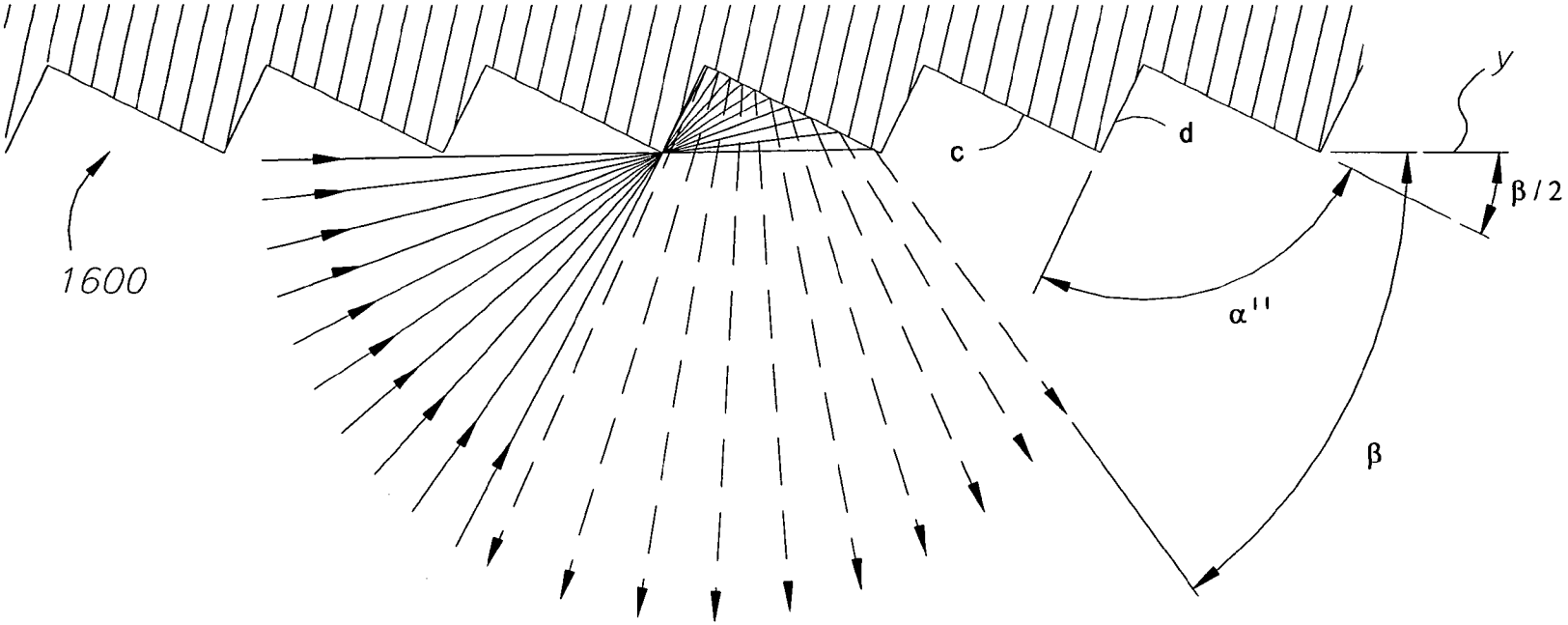
FIG. 17 is an enlarged cross-sectional profile view of a portion of another surface of the invention showing the redirection of light rays in accordance with the invention.
Figure 18:
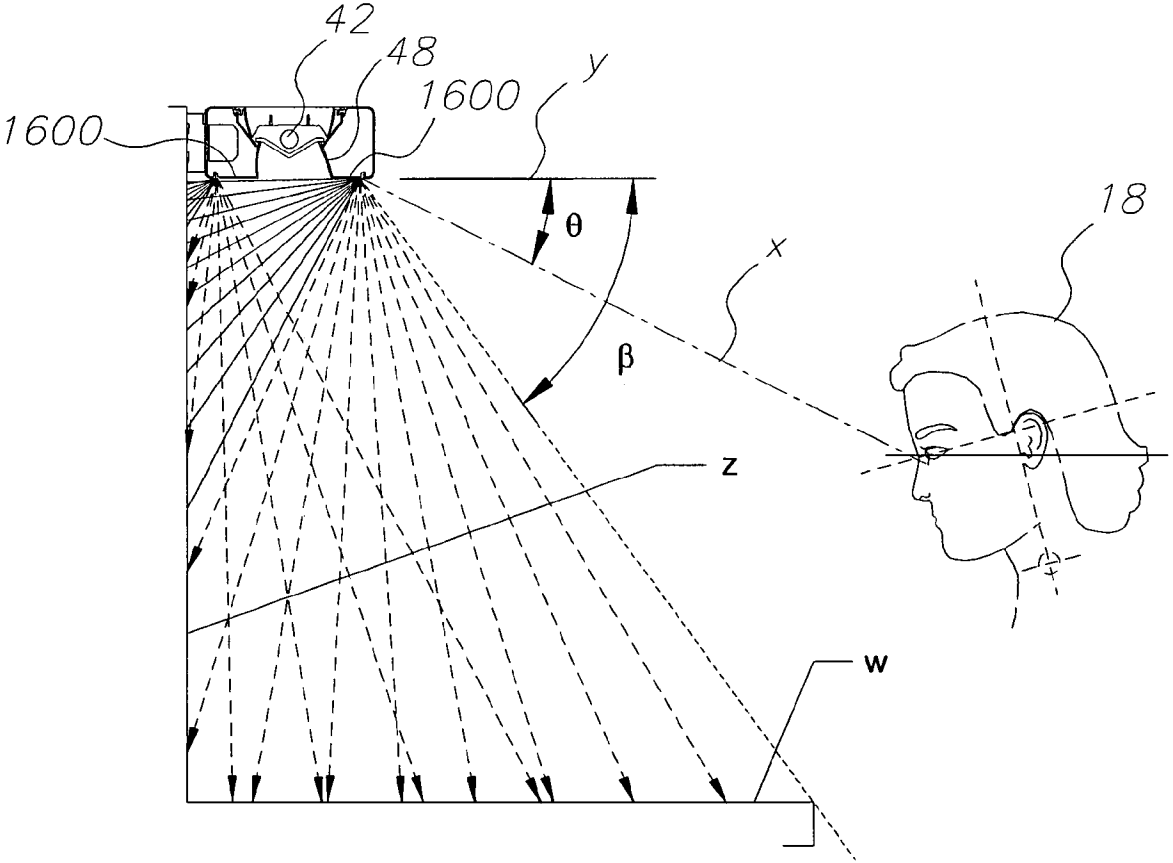
FIG. 18 is a simplified view illustrating a workstation including a luminaire having the surface of FIG. 17 and further illustrating the redirection of light rays as shown in FIG. 17 in accordance with the invention.

FIGS. 17 and 18 illustrate how a contoured reflector surface 1600 of the invention configured according to angle β (where β>θ or β>θ' as the case may be and where angle β is the angle between line y tangential to surface 1600 and a line defined by the outboard edge of the horizontal task surface and the nearest edge of the contoured surface 1600) effectively directs reflected light rays only to workstation surfaces w and z. That is, the surfaces 1600 do not, for example, redirect light incident thereon at an angle greater than β beyond the horizontal surface w toward the viewer 18, as occurs in the arrangement of FIGS. 7 and 16. Angle α" between each long lateral profile segment c and short lateral profile segment d of each groove is approximately 90°. This relationship causes any reflected light rays that encounter two adjacent segments c, d to be ultimately redirected back along (i.e. parallel to) the lines at which they respectively encountered the first said segment in a manner similar to that shown in FIGS. 10-12 of the first embodiment of the invention, thus maintaining the exchange of light rays between the lighted workstation surfaces and said reflector segments. The angle β in one exemplary embodiment is approximately 40° to approximately 60°.

Alternatively, other contoured surface profiles can be constructed in accordance with the invention to redirect and refocus reflected light within a workstation and below the viewing angle.

Figure 19A:
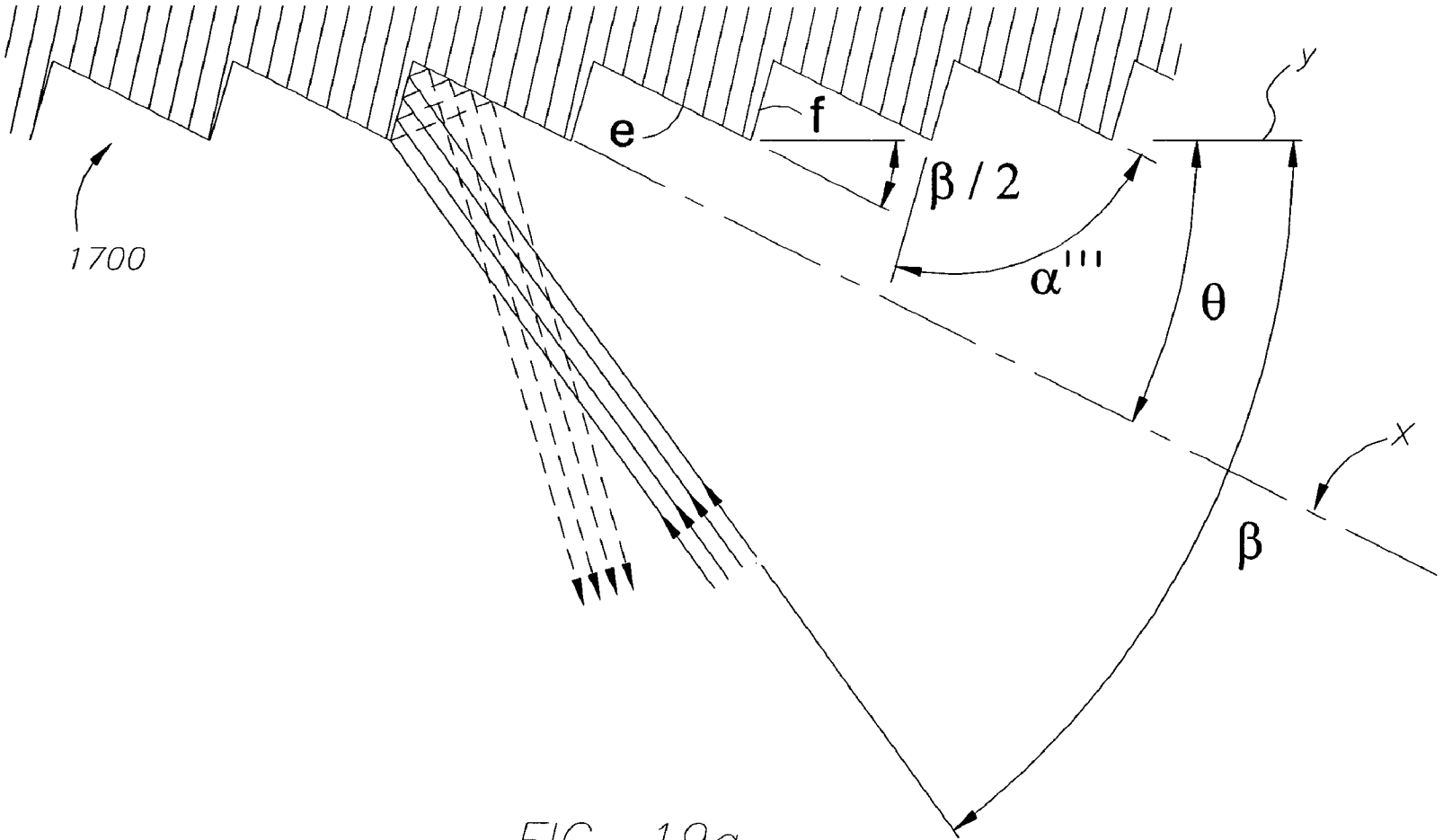
FIGS. 19*a* and 19*b* are enlarged cross-sectional profile views of a portion of another surface of the invention showing the redirection of light rays in accordance with the invention.
Figure 19B:
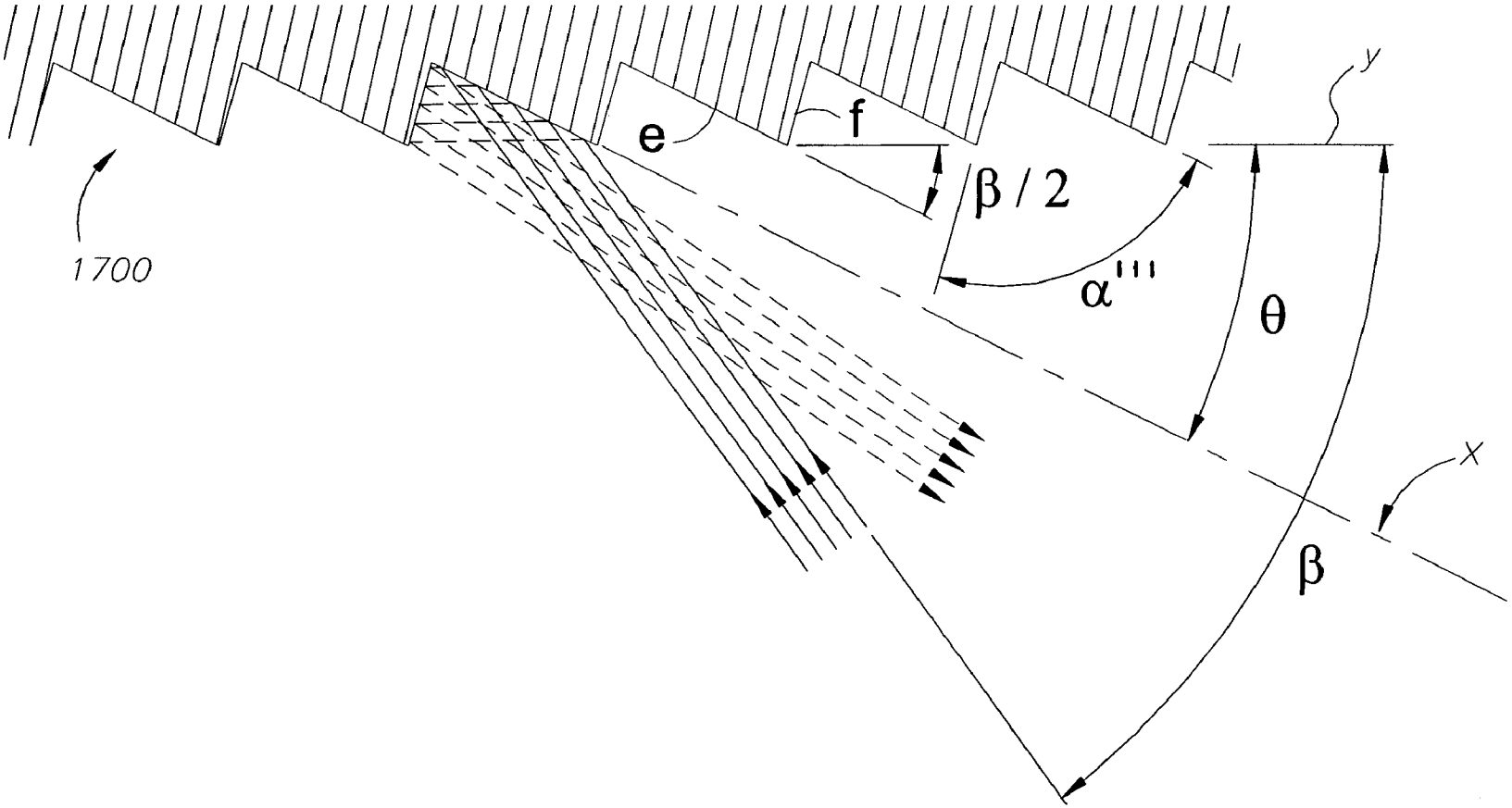

FIGS. 19*a* and 19*b* illustrate another contoured reflector surface 1700 of the invention configured according to angle β with long lateral segments e and short lateral segments f such that reflected light rays that encounter the long lateral reflector segments e without subsequently encountering the short lateral segments f are advantageously redirected in a manner similar to that shown in FIG. 17. However, in this example, angle α''' between each long lateral profile segment e and short lateral profile segment f of each groove is shown to be less than 90°. In this exemplary embodiment, 90°>α'''>½(β-θ), i.e. α''' is less than 90° but not less than ½(β-θ). If α''' is less than ½(β-θ), dually reflected light rays from the horizontal worksurface may be directed above the sightline x. This arrangement causes some of the dually reflected light rays (e.g. those received first by segments f and subsequently by segments e as shown in FIG. 19*a*) to be redirected with reference to tangent line y at angles greater than angle β, and causes other dually reflected light rays (e.g. those received first by segments e and subsequently by segments f as shown in FIG. 19*b*) to be redirected with respect to tangent line y at angles less than angle β. Notably, none of the reflected light rays are directed above sightline x, i.e., all are redirected by surface 1700 at an angle to tangent line y greater than the viewing angle θ. Thus all light rays received by the contoured reflector surface 1700 of the invention from the workstation surfaces are redirected below the sightline and a low-brightness appearance is achieved.

Figure 20:
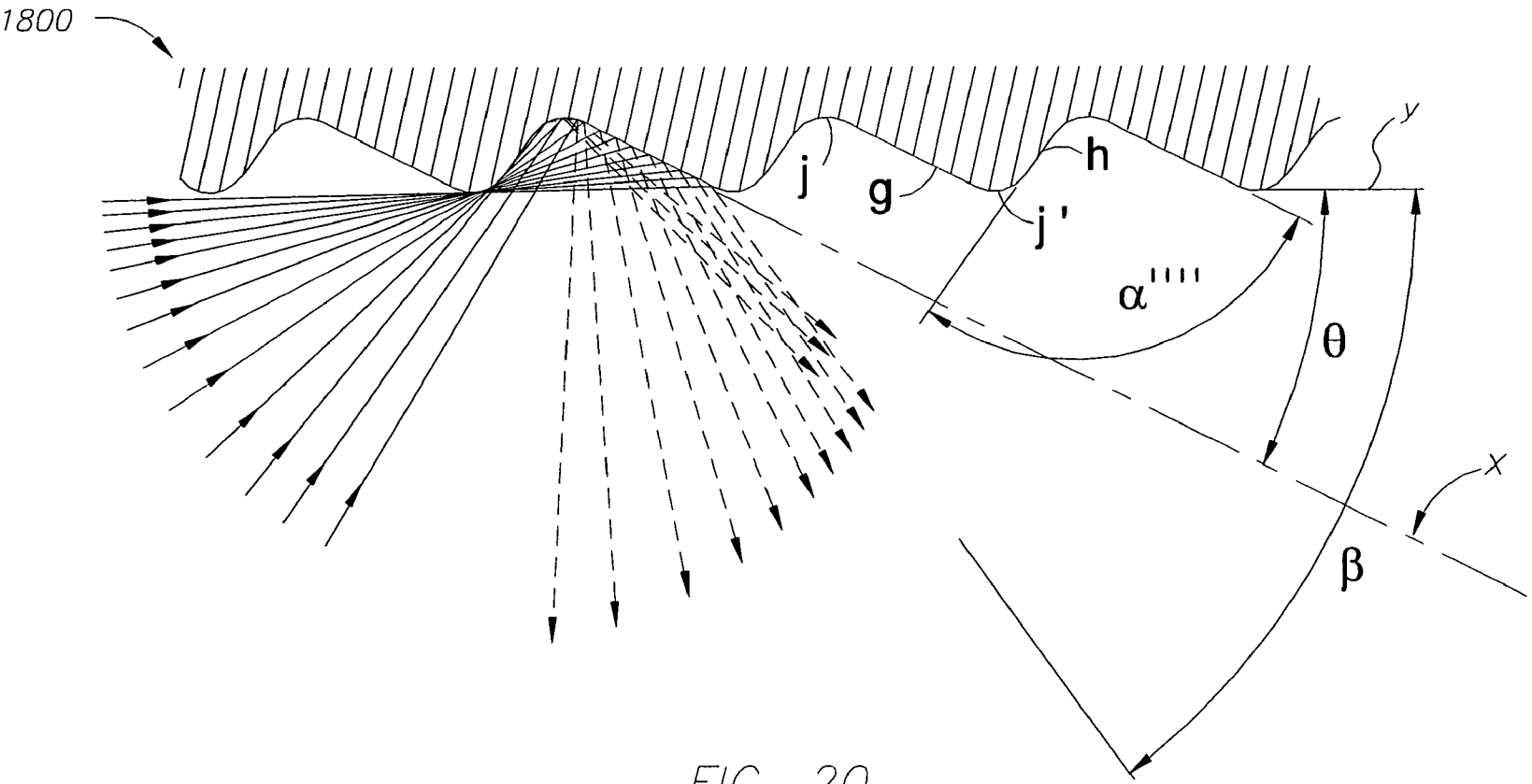
FIGS. 20, 21*a* and 21*b* are enlarged cross-sectional profile views of a portion of yet another surface of the invention showing the redirection of light rays in accordance with the invention.
Figure 21A:
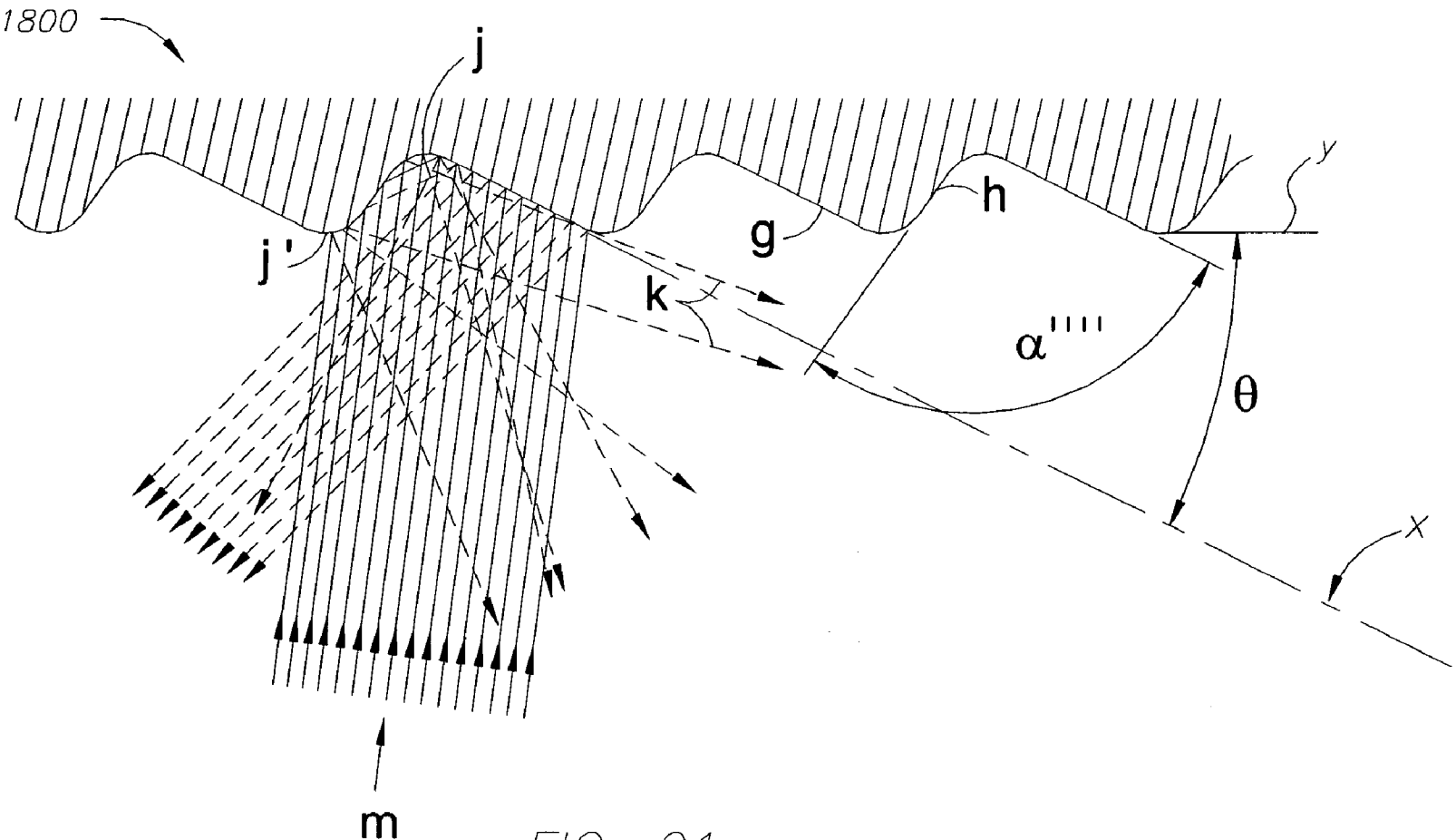
Figure 21B:
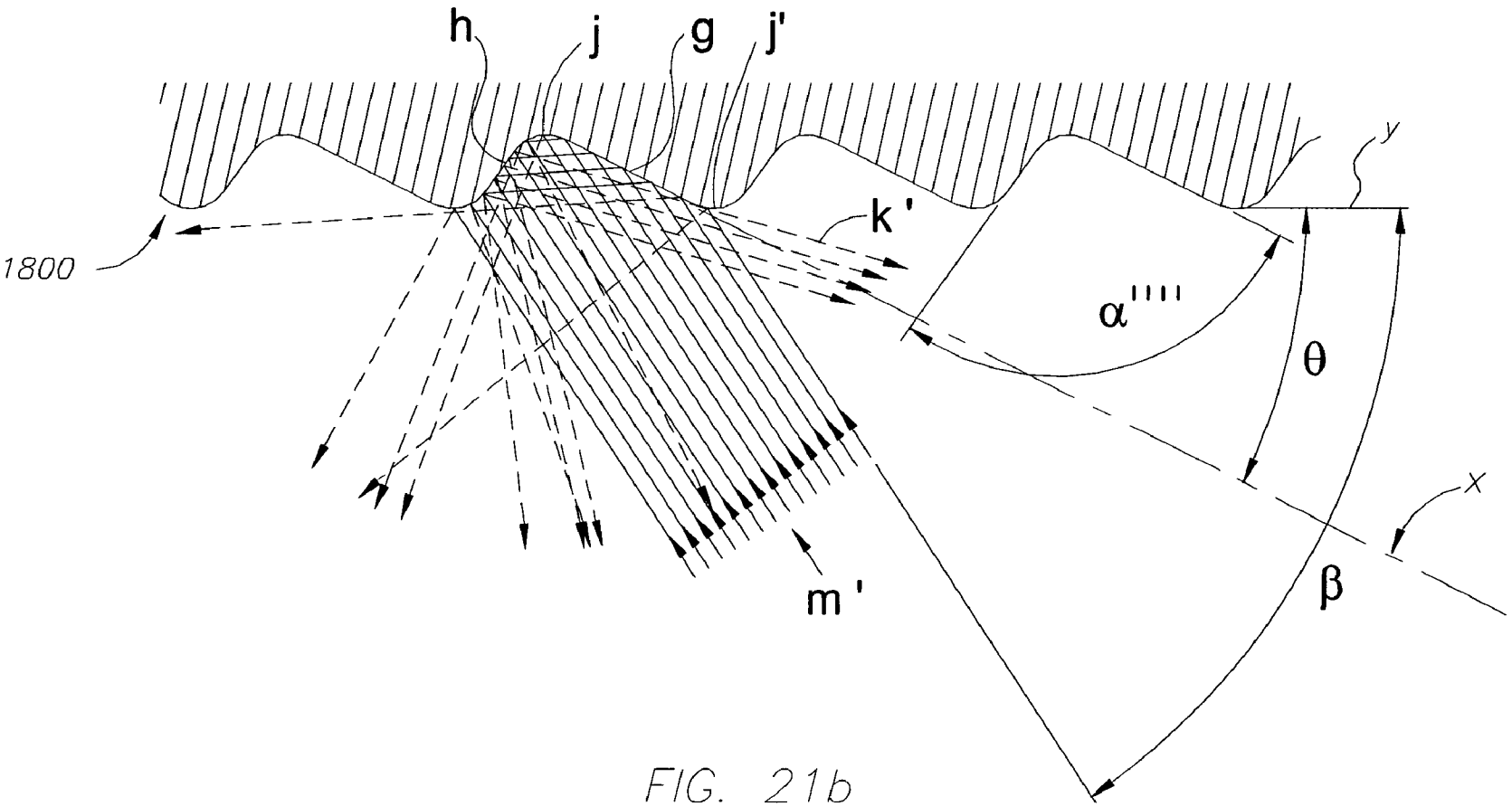

FIGS. 20, 21*a* and 21*b* illustrate another contoured reflector surface 1800 of the invention configured according to angle β with long lateral segments g and short lateral segments h. In this example reflector segments g and h are joined by curved lateral profile segments j and j', and angle α'''' between said lateral short and long segments is greater than 90 degrees (e.g., approximately 100 degrees, as shown). Curved lateral segments j and j' may occur as a result of forming, molding or otherwise fashioning the reflector using known methods. All three FIGS. 20, 21*a*, and 21*b* illustrate how light rays received by the reflector (shown in solid lines), such as those reflected by nearby lighted workstation surfaces, etc., are largely and advantageously redirected within the workstation (below sightline x) in accordance with the invention. That is, as in the previously discussed embodiment, many of the light rays are redirected by the surface 1800 at angles greater than β, with reference to tangent line y, and most all of the light rays incident upon surface 1800 are redirected thereby at angles greater than θ and are hence kept below the sightline x. However, FIGS. 21*a* and 21*b* further illustrate how a small number of light rays received by the reflector from directions m and m' respectively are redirected above viewing line x. Specifically, some of light rays m (shown in FIG. 21*a*) are received and redirected by curved lateral segments j and j'. The corresponding redirected light rays k are subsequently directed above the viewing line x. Similarly, some of light rays m' (shown in FIG. 21*b*) are received by short lateral profile segment h. The corresponding redirected light rays k' are subsequently directed above the viewing line x. Although a similar number of light rays received by the reflector 1800 from directions other than m and m' are also likely to be redirected above the viewing line, the number of such light rays remains small compared to the total number of rays received by the reflector 1800 from any selected direction. Thus, notwithstanding the orientation of the short lateral profile segments h relative to the long lateral profile segments g and the occurrence of curved lateral profile segments j and j', a largely advantageous redirection of light rays is achieved by the surface 1800.

Although luminaire surfaces of the invention integrally formed with luminaire reflectors simplify construction of workstation luminaires by reducing manufacturing complexity and finishing requirements, luminaire surfaces of the invention need not be integrally formed with reflector surfaces. Instead, they can be separately fabricated or integrally formed with other luminaire components.

Figure 22:
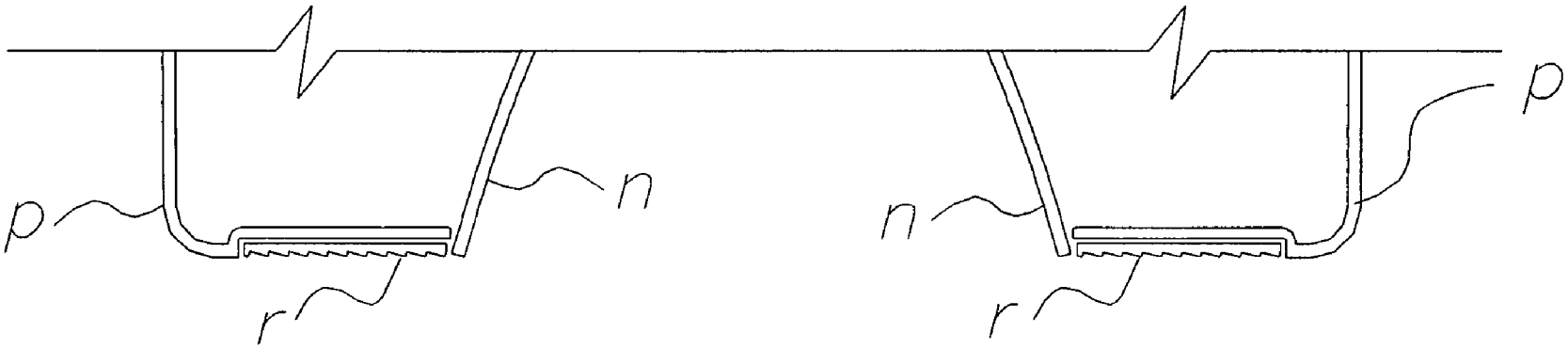
FIG. 22 is a partial cross sectional profile view of a luminaire having surfaces for redirecting received light in accordance with the invention.
Figure 23:
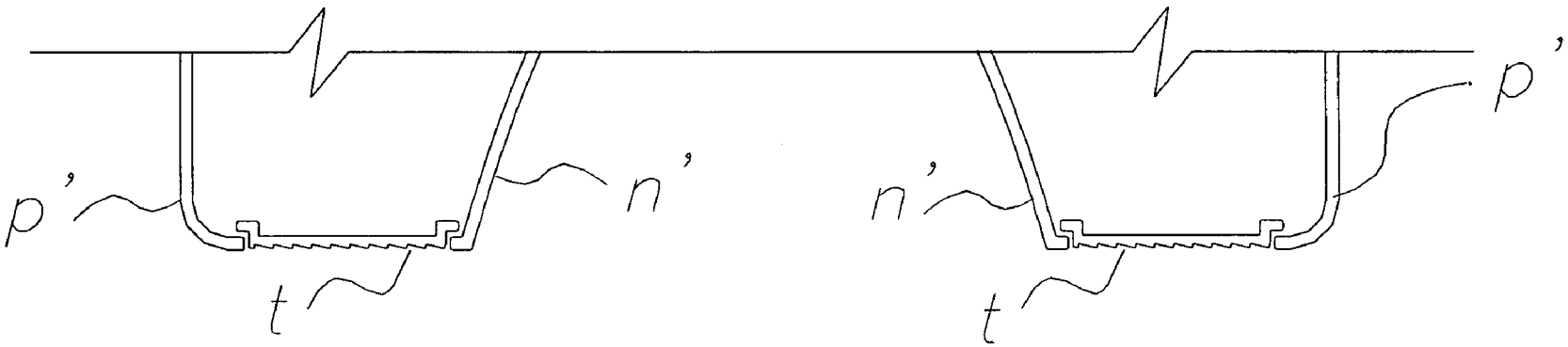
FIG. 23 is a partial cross sectional profile view of another luminaire having surfaces for redirecting received light in accordance with the invention.
Figure 24:
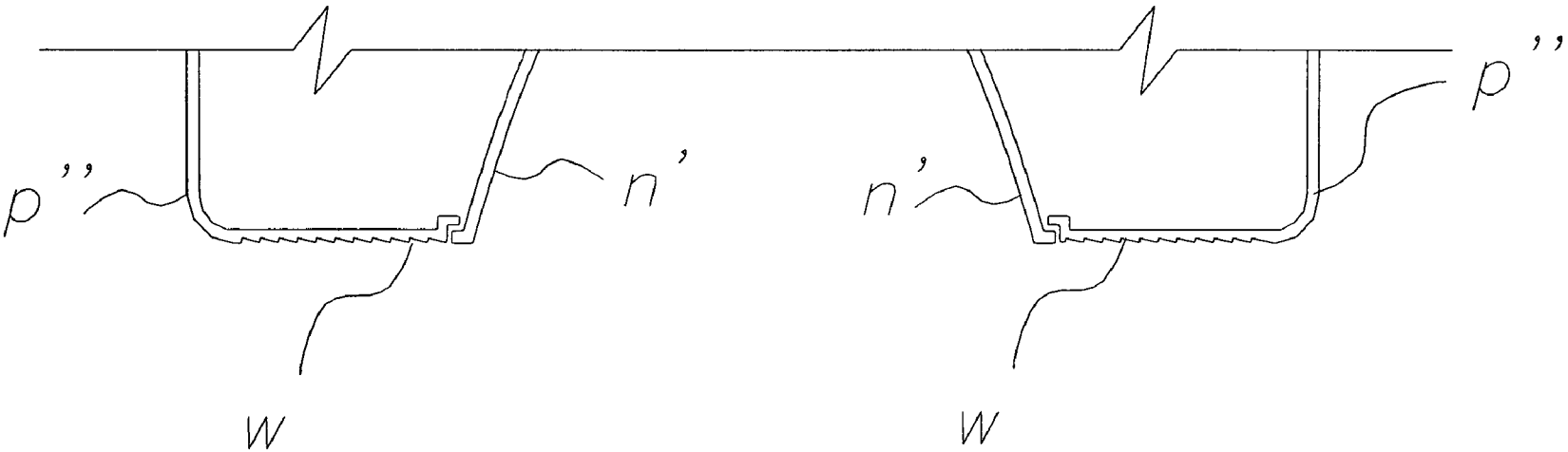
FIG. 24 is a partial cross sectional profile view of yet another luminaire having surfaces for redirecting received light in accordance with the invention.

FIG. 22 shows contoured reflector surfaces r, according to the invention, as applied or otherwise fixed to the bottom of a luminaire housing p where surfaces r are a separable part (i.e., they are not an integral extension of reflectors n, housing p or any other luminaire part), have a high reflectance specular finish, and do not themselves serve as a bottom closure for the luminaire. That is, the luminaire closes by adjoining the housing p with the internal reflectors n; the contoured reflector surfaces r are fitted into or onto the housing p, as shown, by any available means. FIG. 23 shows additional contoured surfaces t in accordance with the invention assembled in association with a luminaire housing p' and reflectors n' where surfaces t are also a separable, non-integral part, have a high reflectance specular finish, and form the bottom closure of the luminaire. That is, the housing p' attaches to one side of each contoured surface t and the reflectors n' attach to the opposite side of the surfaces t to thus form the luminaire. Here, the surfaces t each include latching features s which serve to affix the surfaces t respectively to the housing p' and reflector t. FIG. 24 shows contoured surfaces w in accordance with the invention formed as an integral part of a luminaire housing p" and forming the bottom closure of the luminaire. In this example, luminaire housing p" (including surfaces w) may have a high reflectance specular finish, or may have multiple finishes with surfaces w having a high reflectance specular finish. Here, the integrally formed surfaces w comprise the bottom surface and bottom closure of the luminaire. That is, the contoured surfaces w each include the latching feature s which serves to affix the surface w to the reflector n'. The latching feature s as shown in FIGS. 23 and 24 comprises a hook or other means for selectively and detachably engaging the contoured surfaces t and w with the various reflector and housing portions of the luminaire of the invention. Notably, in each case the contoured surfaces may be permanently fixed or detachable depending on any requirements, or lack thereof, for access to the interior of the luminaire.

Furthermore, luminaire surfaces of the invention may be fabricated with any of a variety of specular materials and/or finishes, including but not limited to, bright anodized extruded aluminum, formed aluminum reflector sheet, and metalized extruded or molded plastic.

The contoured reflective surfaces of the invention are shown and described herein by way of example as being disposed on the underside of the luminaire. Alternatively, of course, the contoured surfaces may be disposed elsewhere on the exterior of the luminaire. For example, the surfaces may be disposed on or extending from sides of the luminaire. Further alternatively, the contoured surfaces may be partially or entirely independent from the luminaire housing and thus may be separately mountable on the vertical and/or horizontal surfaces of the workstation or on cabinets, etc., mounted above or proximate to the luminaire. Additional such configurations and variations of the invention are herein contemplated.

Although as shown in the drawings as exterior surfaces, luminaire surfaces of the invention need not be exterior surfaces of a luminaire. Instead, they can be other luminaire surfaces oriented or positioned to redirect any received light as desired. For example, the reflective contoured surfaces of the invention may be disposed, with reference to FIG. 3, toward the interior of the luminaire 40 (i.e., within the downlight aperture) adjacent to the reflectors 48, proximate to the lamp 42, etc.

Note that luminaires of the invention are not limited to workstation applications, but can include other types of direct and direct/indirect luminaires that can be in positions and/or orientations other than those shown. For example, a luminaire according to the invention may be disposed and oriented so as to illuminate at least part of a wall and/or ceiling. In such configuration, the reflective contoured surface(s) may be disposed so as to receive certain light rays (not directly from a lamp of such luminaire) and to redirect such light rays away from a viewing angle of a viewer and toward the wall and/or ceiling to thus control reflections on the luminaire exterior and/or to enhance the overall efficiency of the luminaire. The light rays received by the contoured surfaces may be reflected from the ceiling and/or wall and/or from objects proximate to the ceiling and/or wall, or the light rays may emanate from outside sources, etc.

Additionally, luminaires of the invention are not limited to the configurations and reflector profiles shown in the figures. That is, the reflectors (shown, e.g., at reference numeral 48 in FIG. 3) and the reflective contoured surfaces (shown in exemplary form at numeral 50 in FIG. 3) are described merely in illustrative terms and may assume any shape, orientation, or configuration in order to receive and redirect light rays to and/or from a prescribed area, as discussed herein.

Thus it is seen that luminaires having surfaces for advantageously redirecting received light are provided. One skilled in the art will appreciate that the invention can be practiced by other than the described embodiments, which are presented for purposes of illustration and not of limitation, and the present invention is limited only by the claims which follow.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

I claim:

1. A luminaire for illuminating a target area, comprising:

a housing;

a reflective surface; and a lamp for illuminating the target area;

wherein the reflective surface is disposed on an exterior of said housing and the lamp is disposed at an interior of said housing;

wherein the reflective surface is positioned to avoid direct light from the lamp and direct light from any other portion of the luminaire, and wherein the reflective surface receives a light from the exterior of the luminaire and redirects the light toward the target area away from a viewing angle of the luminaire.

2. The luminaire of claim 1, wherein said reflective surface comprises a bottom surface of the luminaire and further comprises a bottom closure of the housing of the luminaire.

3. The luminaire of claim 1, further comprising:

an aperture formed in the housing;

wherein the lamp is disposed within the aperture; and wherein the reflective surface is formed on the exterior of the housing proximate to the aperture.

4. The luminaire of claim 1, further comprising:

a lamp reflector disposed proximate to the lamp and in direct view of the lamp for receiving lamp light directly from the lamp and reflecting the lamp light to the target area;

wherein the lamp light is not directly received by the reflective surface; and wherein the lamp light reflected by the lamp reflector is not directly received by the reflective surface.

5. The luminaire of claim 1, wherein a sight line from a viewer's eye to the reflective surface forms the viewing angle with the reflective surface and wherein the light is redirected by the reflective surface outside of the viewing angle and wherein the viewing angle is delimited by the sightline and a line generally tangent to the reflective surface extending in a direction of the viewer.

6. The luminaire of claim 5, wherein the target area is disposed below the sightline and wherein the redirected light is redirected at an angle to the tangent line greater than the viewing angle.

7. The luminaire of claim 1, wherein the reflective surface comprises a contoured surface and wherein the contoured surface is positioned such that said surface:

does not receive light directly from the lamp of said luminaire;

does not receive reflected light directly from a reflector of said luminaire; and receives light reflected from an object, said light reflected from said object originating from said lamp of said luminaire.

8. The luminaire of claim 7, wherein the contoured surface comprises a sawtooth-shaped cross-sectional profile comprising a series of alternating first and second lateral segments.

9. The luminaire of claim 8, wherein the second lateral segments have a length shorter than a length of the first lateral segments and wherein the first and second lateral segments are formed generally perpendicular to one another.

10. The luminaire of claim 8, wherein rounded segments connect the perpendicularly disposed first and second lateral segments.

11. The luminaire of claim 8, wherein the first and second segments receive said light and redirect said light to the target area at an angle to the reflective surface greater than the viewing angle, wherein the viewing angle is delimited by a line tangential to the reflective surface and a sightline extending from a viewer's eye to the reflective surface.

12. The luminaire of claim 8, wherein peaks and grooves are alternatingly formed by the intersection of the first and second segments.

13. The luminaire of claim 12, wherein the first segments are disposed at an angle to a tangent line which extends generally tangential to the peaks, wherein the angle of the first segments is about one-half of the viewing angle, wherein the viewing angle is delimited by the tangent line and a sightline extending from an eye of a viewer to a front portion of the reflective surface, and wherein the first and second segments redirect said light to the target area at an angle to the tangent line which is greater than the viewing angle.

14. The luminaire of claim 7, wherein the contoured surface comprises a plurality of ridges and a plurality of corresponding grooves, wherein the ridges and grooves are delimited by a series of alternating first and second surfaces of unequal length, wherein each said ridge has a peak and a longer of said two unequal length surfaces forms an acute angle with a line tangential to said ridge peaks.

15. The luminaire of claim 14, wherein said acute angle is about 5 to about 25 degrees.

16. The luminaire of claim 14, wherein the first and second surfaces redirect said light to said target area at an angle to a line tangential to the ridges greater than the viewing angle, wherein the viewing angle is delimited by the tangent line and a sightline extending from a viewer's eye to the reflective surface.

17. The luminaire of claim 14, wherein said ridges and grooves run substantially parallel to the linear lamp of said luminaire, and wherein said first and second surfaces redirect said light to the target area in a direction generally perpendicular to said ridges and grooves and generally away from a viewer positioned proximate the target area, outside the viewing angle, so as to reduce reflections seen by the viewer.

18. A luminaire, comprising:

a housing having a body which defines an interior of the housing and an exterior of the housing;

an opening in the housing delimited by the body, wherein said interior and exterior converge at said opening;

a lamp fixed to the body at the interior of the housing proximate to the opening;

an interior reflector proximate to the lamp and to the opening;

an exterior reflector disposed on the body at the exterior of the housing;

wherein the lamp is configured to propagate light rays directly through the opening to a target area at the exterior of the housing without interaction of the interior and exterior reflectors;

wherein the lamp is further configured to propagate light rays to the interior reflector and wherein said interior reflector is positioned to re-direct said light rays to the target area;

wherein the exterior reflector is positioned to receive light rays emanating from the exterior of the housing and to re-direct said light rays to the target area; and wherein the exterior reflector is shielded from the lamp such that light rays emanating from the lamp are impeded from directly striking the exterior reflector.

19. A luminaire for illuminating a target area, comprising:

a housing;

an exterior reflective surface disposed at an exterior of the housing;

and interior reflective surface disposed at an interior of the housing; and a lamp for illuminating the target area;

wherein the exterior reflective surface is shielded from light emanating from the lamp, wherein the interior reflective surface receives light directly from the lamp, and wherein the exterior reflective surface is integrally formed with the interior reflective surface.

20. A luminaire for illuminating a target area, comprising:

a lamp; and a reflective surface;

wherein the lamp emits a lamp light to illuminate the target area;

wherein the reflective surface is positioned to avoid direct light from the lamp and direct light from any other portion of the luminaire;

wherein the reflective surface receives an outside light from outside of the luminaire and redirects the light toward the target area and outside of a viewing angle of the luminaire, and wherein the viewing angle comprises an angle formed between a line tangent to the reflective surface and a sightline extending between an eye of a viewer and the reflective surface.

21. The luminaire of claim 20, wherein the reflective surface comprises a contoured surface having a substantially sawtooth-shaped cross-sectional profile comprising a series of alternating first and second lateral segments.

22. The luminaire of claim 21 wherein the contoured surface is positioned such that said surface:

does not receive light directly from a lamp of said luminaire;

does not receive reflected light directly from a reflector of said luminaire; and receives light reflected from an object, said light reflected from said object originating from said lamp of said luminaire.

23. The luminaire of claim 21, wherein the second lateral segments have a length shorter than a length of the first lateral segments, wherein the first and second lateral segments are formed generally perpendicular to one another, and wherein said first and second lateral segments are disposed to redirect the outside light away from the viewer to reduce glare from the luminaire to the viewer.

24. A workstation comprising:

a work surface; and a luminaire for illuminating the worksurface;

wherein the luminaire is mounted proximate to said work surface;

wherein said luminaire comprises a reflective surface;

wherein the reflective surface receives a light from outside of the luminaire and redirects the light to the worksurface and away from a worker positioned at the workstation, and wherein the reflective surface is positioned to avoid direct light from the lamp and direct light from any other portion of the luminaire.

25. The workstation of claim 24, further comprising:

a lamp;

wherein the lamp emits a lamp light to illuminate the worksurface;

wherein the reflective surface does not directly receive the lamp light;

wherein the reflective surface redirects the light to the worksurface at an angle to the reflective surface greater than a viewing angle of the worker; and wherein the viewing angle is delimited by a line tangential to the reflective surface and a sightline extending from the worker's eye to the reflective surface.

26. The workstation of claim 24, wherein the reflective surface comprises a contoured surface having at least one angled surface for receiving the outside light and redirecting the light to the work surface away from the worker, wherein the worksurface comprises a horizontal surface and a vertical surface disposed adjacent to the horizontal surface, and wherein the luminaire is mounted on the vertical surface.

27. The workstation of claim 24, wherein the reflective surface comprises a contoured surface having a sawtooth-shaped cross-sectional profile comprising a series of alternating first and second lateral segments, wherein the second lateral segments have a length shorter than a length of the first lateral segments, wherein the first and second segments receive said light and redirect said light to the target area at an angle to a line tangential to the reflective surface greater than a viewing angle, wherein the viewing angle is delimited by the tangential line and a sightline extending from the worker's eye to the reflective surface.

28. A method of illuminating a target area and preventing glare to a viewer, the method comprising:

emitting a lamp light from a luminaire directly to the target area, positioning a reflective surface at an exterior of a housing of the luminaire such that the reflective surface avoids direct light from the lamp and direct light from any other portion of the luminaire;

receiving an outside light at the luminaire; and redirecting the outside light to the target area and away from a sightline extending from a viewer to the luminaire such that the redirected light does not present a glare to the viewer;

wherein the outside light is not received directly from the luminaire.

29. The method of claim 28, wherein said redirecting of said outside light comprises:

providing a contoured surface proximate to the target area, the contoured surface comprising a plurality of angled surfaces; and reflecting said outside light with said angled surfaces to the target area at an angle to the tangent line greater than the viewing angle;

wherein the tangent line comprises a line tangential to the angled surfaces.

* * * * *